US007757982B2

(12) United States Patent
Matlin

(10) Patent No.: US 7,757,982 B2
(45) Date of Patent: Jul. 20, 2010

(54) SHREDDER WITH INTELLIGENT ACTIVATION SWITCH

(75) Inventor: Taihoon Kim Matlin, Round Lake Beach, CA (US)

(73) Assignee: Fellowes, Inc., Itasca, IL (US)

( * ) Notice: Subject to any disclaimer, the term of this patent is extended or adjusted under 35 U.S.C. 154(b) by 869 days.

(21) Appl. No.: 11/536,415

(22) Filed: Sep. 28, 2006

(65) Prior Publication Data

US 2008/0099590 A1 May 1, 2008

(51) Int. Cl.
*B02C 25/00* (2006.01)

(52) U.S. Cl. ..... 241/36; 241/37.5; 241/100

(58) Field of Classification Search ..... 241/37.5, 241/100, 236, 33, 36, 34
See application file for complete search history.

(56) References Cited

U.S. PATENT DOCUMENTS

| | | | | |
|---|---|---|---|---|
| 3,764,819 | A * | 10/1973 | Muller | 307/116 |
| 3,947,734 | A | 3/1976 | Fyler | |
| 4,814,632 | A | 3/1989 | Glaeser | |
| 4,914,721 | A | 4/1990 | Glaeser | |
| 5,353,468 | A | 10/1994 | Yap | |
| 5,453,644 | A | 9/1995 | Yap | |
| D412,716 | S | 8/1999 | Kroger | |
| D414,198 | S | 9/1999 | Iwata | |
| 6,065,696 | A | 5/2000 | Tsai | |
| D426,805 | S | 6/2000 | Iwata | |
| 6,079,645 | A | 6/2000 | Henreckson | |
| 6,418,004 | B1 | 7/2002 | Mather et al. | |
| 6,655,943 | B1 | 12/2003 | Peterson | |
| 6,813,983 | B2 | 11/2004 | Gass et al. | |
| 6,826,988 | B2 | 12/2004 | Gass et al. | |
| 6,857,345 | B2 | 2/2005 | Gass et al. | |
| 6,877,410 | B2 | 4/2005 | Gass et al. | |
| 6,880,440 | B2 | 4/2005 | Gass et al. | |

(Continued)

FOREIGN PATENT DOCUMENTS

| | | |
|---|---|---|
| DE | 33 13 232 | 10/1984 |

(Continued)

OTHER PUBLICATIONS

International Search Report issued in PCT/US07/77268, May 19, 2008, 2 pages.

(Continued)

*Primary Examiner*—Faye Francis
(74) *Attorney, Agent, or Firm*—Pillsbury Winthrop Shaw Pittman LLP

(57) ABSTRACT

A shredder includes a housing, a shredder mechanism including a motor and cutter elements, a capacitive sensor, and a controller. The capacitive sensor is configured to detect the capacitance of an entity attempting to operate the shredder and thereby detect an appropriate indication of the relative size of the entity because relative size can be an effective indicator of age of the entity. The controller is coupled to the capacitive sensor and is configured to enable/disable operation of the shredder based on the detected capacitance. As a result, the controller and capacitive sensor are configured to cooperate to detect some indication of age, and therefore, maturity, to safely operate the shredder. As a result, a mechanism is provided which results in an increased safety function for the shredder by ensuring that the operator is capable of safely operating the shredder.

22 Claims, 29 Drawing Sheets

U.S. PATENT DOCUMENTS

| | | | | |
|---|---|---|---|---|
| 6,920,814 | B2 | 7/2005 | Gass et al. | |
| 6,962,301 | B1 * | 11/2005 | Chang | 241/100 |
| 6,968,746 | B2 | 11/2005 | Shank | |
| 6,979,813 | B2 | 12/2005 | Avril | |
| 6,984,218 | B2 | 1/2006 | Nayak | |
| 6,995,670 | B2 | 2/2006 | Wadlow | |
| 6,995,747 | B2 | 2/2006 | Casebolt | |
| 7,040,559 | B2 | 5/2006 | Matlin et al. | |
| 2002/0017175 | A1 | 2/2002 | Gass et al. | |
| 2002/0017176 | A1 | 2/2002 | Gass et al. | |
| 2002/0017178 | A1 | 2/2002 | Gass et al. | |
| 2002/0017179 | A1 | 2/2002 | Gass et al. | |
| 2002/0017180 | A1 | 2/2002 | Gass et al. | |
| 2002/0017181 | A1 | 2/2002 | Gass et al. | |
| 2002/0017182 | A1 | 2/2002 | Gass et al. | |
| 2002/0017184 | A1 | 2/2002 | Gass et al. | |
| 2002/0017336 | A1 | 2/2002 | Gass et al. | |
| 2002/0020261 | A1 | 2/2002 | Gass et al. | |
| 2002/0020262 | A1 | 2/2002 | Gass et al. | |
| 2002/0020263 | A1 | 2/2002 | Gass et al. | |
| 2002/0020265 | A1 | 2/2002 | Gass et al. | |
| 2002/0020271 | A1 | 2/2002 | Gass et al. | |
| 2002/0056348 | A1 | 5/2002 | Gass et al. | |
| 2002/0056349 | A1 | 5/2002 | Gass et al. | |
| 2002/0056350 | A1 | 5/2002 | Gass et al. | |
| 2002/0059853 | A1 | 5/2002 | Gass et al. | |
| 2002/0059854 | A1 | 5/2002 | Gass et al. | |
| 2002/0059855 | A1 | 5/2002 | Gass et al. | |
| 2002/0066346 | A1 | 6/2002 | Gass et al. | |
| 2002/0069734 | A1 | 6/2002 | Gass et al. | |
| 2002/0170399 | A1 | 11/2002 | Gass et al. | |
| 2002/0170400 | A1 | 11/2002 | Gass | |
| 2002/0190581 | A1 | 12/2002 | Gass et al. | |
| 2003/0002942 | A1 | 1/2003 | Gass et al. | |
| 2003/0005588 | A1 | 1/2003 | Gass et al. | |
| 2003/0015253 | A1 | 1/2003 | Gass et al. | |
| 2003/0019341 | A1 | 1/2003 | Gass et al. | |
| 2003/0020336 | A1 | 1/2003 | Gass et al. | |
| 2003/0037651 | A1 | 2/2003 | Gass et al. | |
| 2003/0056853 | A1 | 3/2003 | Gass et al. | |
| 2003/0058121 | A1 | 3/2003 | Gass et al. | |
| 2003/0090224 | A1 | 5/2003 | Gass et al. | |
| 2003/0131703 | A1 | 7/2003 | Gass et al. | |
| 2003/0140749 | A1 | 7/2003 | Gass et al. | |
| 2003/0196824 | A1 | 10/2003 | Gass et al. | |
| 2004/0008122 | A1 | 1/2004 | Michael | |
| 2004/0040426 | A1 | 3/2004 | Gass et al. | |
| 2004/0163514 | A1 | 8/2004 | Gass et al. | |
| 2004/0173430 | A1 | 9/2004 | Gass | |
| 2004/0194594 | A1 | 10/2004 | Dils | |
| 2004/0226800 | A1 | 11/2004 | Pierga | |
| 2005/0039586 | A1 | 2/2005 | Gass et al. | |
| 2005/0039822 | A1 | 2/2005 | Gass et al. | |
| 2005/0041359 | A1 | 2/2005 | Gass | |
| 2005/0066784 | A1 | 3/2005 | Gass | |
| 2005/0103510 | A1 | 5/2005 | Gass et al. | |
| 2005/0139051 | A1 | 6/2005 | Gass et al. | |
| 2005/0139056 | A1 | 6/2005 | Gass et al. | |
| 2005/0139057 | A1 | 6/2005 | Gass et al. | |
| 2005/0139058 | A1 | 6/2005 | Gass et al. | |
| 2005/0139459 | A1 | 6/2005 | Gass et al. | |
| 2005/0155473 | A1 | 7/2005 | Gass | |
| 2005/0166736 | A1 | 8/2005 | Gass et al. | |
| 2005/0218250 | A1 | 10/2005 | Matlin | |
| 2005/0236503 | A1 | 10/2005 | Matlin | |
| 2006/0091247 | A1 | 5/2006 | Matlin | |

FOREIGN PATENT DOCUMENTS

| | | |
|---|---|---|
| DE | 86 19 856.4 | 10/1988 |
| DE | 41 21 330 | 1/1993 |
| EP | 268244 | 11/1987 |
| EP | 562076 | 9/1992 |
| EP | 524708 | 1/1997 |
| EP | 856945 | 1/1998 |
| JP | 52-11691 | 1/1977 |
| JP | 04-157093 | 5/1992 |
| JP | 04-180852 | 6/1992 |
| JP | 9-262491 | 10/1997 |
| JP | 11-216383 | 8/1999 |
| JP | 2000-0346288 | 12/2000 |
| JP | 2004-0321993 | 11/2004 |
| WO | 2005 070553 | 8/2005 |

OTHER PUBLICATIONS

Written Opinion of the International Searching Authority issued in PCT/US07/77268, May 19, 2008, 3 pages.

* cited by examiner

SHREDDER WITH INTELLIGENT ACTIVATION SWITCH

FIELD OF THE INVENTION

The present invention relates to shredders for destroying articles, such as documents, CDs, etc.

BACKGROUND OF THE INVENTION

Shredders are well known devices for destroying articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. It is generally desirable to prevent a person's or animal's body part from contacting these cutter elements during the shredding operation.

The present invention endeavors to provide various improvements over known shredders.

SUMMARY OF THE INVENTION

In accordance with at least one embodiment of the invention, a shredder includes a housing, a shredder mechanism including a motor and cutter elements, a sensor, and a controller. The shredder mechanism enables articles to be shredded to be fed into the cutter elements, and the motor is operable to drive the cutter elements so that the cutter elements shred the articles fed therein.

The housing has an opening enabling articles to be fed therethrough into the cutter elements of the shredder mechanism for shredding. The sensor is operable to detect an inherent electrical characteristic of an operator of the shredder. The sensor is coupled to the controller, which in turn, is coupled to the shredder mechanism. The controller is operable to enable operation of the shredder mechanism provided the sensor detects an operator having an electrical characteristic greater than a predetermined level.

In accordance with at least one embodiment the sensor may be a capacitive sensor and the inherent electrical characteristic may be capacitance. Further, the predetermined level of capacitance may correspond to a predetermined capacitance associated with a human operator of at least 75 lbs.

The shredder controller may include a microcontroller responsive to an activation sensor that includes an electroconductive element and circuitry to sense a state of the electroconductive element; thus, the activation sensor may be configured to detect the inherent electrical characteristic of the operator. The controller may also comprise a microprocessor, discrete circuit components, and/or analog circuitry enabling operation of the shredder when the detected inherent electrical characteristic is within one or more acceptable ranges. Further, the electroconductive element may be a thin metal member extending along a portion of the housing adjacent the opening provided on an interior surface of the housing. Optionally, the metal member may be provided only on an interior surface of the housing, and not on an exterior surface or provided on an exterior surface of the housing. Additionally, the portion of the housing on which the metal member is provided may have an edge that defines part of the opening, wherein the metal member extends from the interior surface of the housing to the exterior surface over the edge. Optionally, the metal member may be metal tape and may be at least in part covered by a non-conductive member, or vice versa. Optionally, the electroconductive element may comprise metal paint applied to a portion of the housing or to a member associated with the housing or include at least two metal members each extending along a portion of the housing.

Other objects, features, and advantages of the present invention will become apparent from the following detailed description, the accompanying drawings and the appended claims.

BRIEF DESCRIPTION OF THE DRAWINGS

Invention embodiments are described in the following detailed description, the accompanying drawings, and the appended claims.

DETAILED DESCRIPTION OF THE ILLUSTRATED EMBODIMENTS

Figure 1:
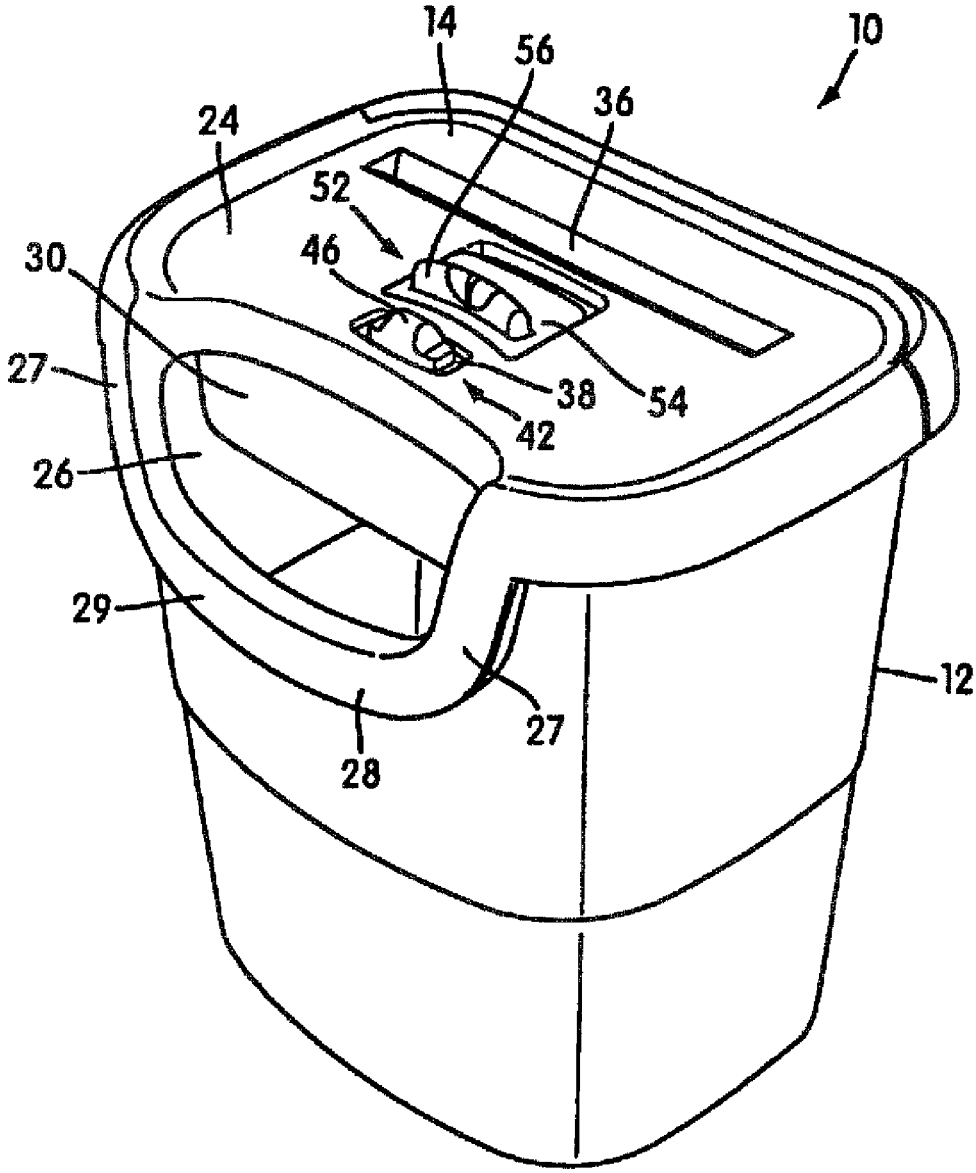
FIG. 1 is a perspective view of a shredder constructed in accordance with at least one embodiment of the present invention.
Figure 2:
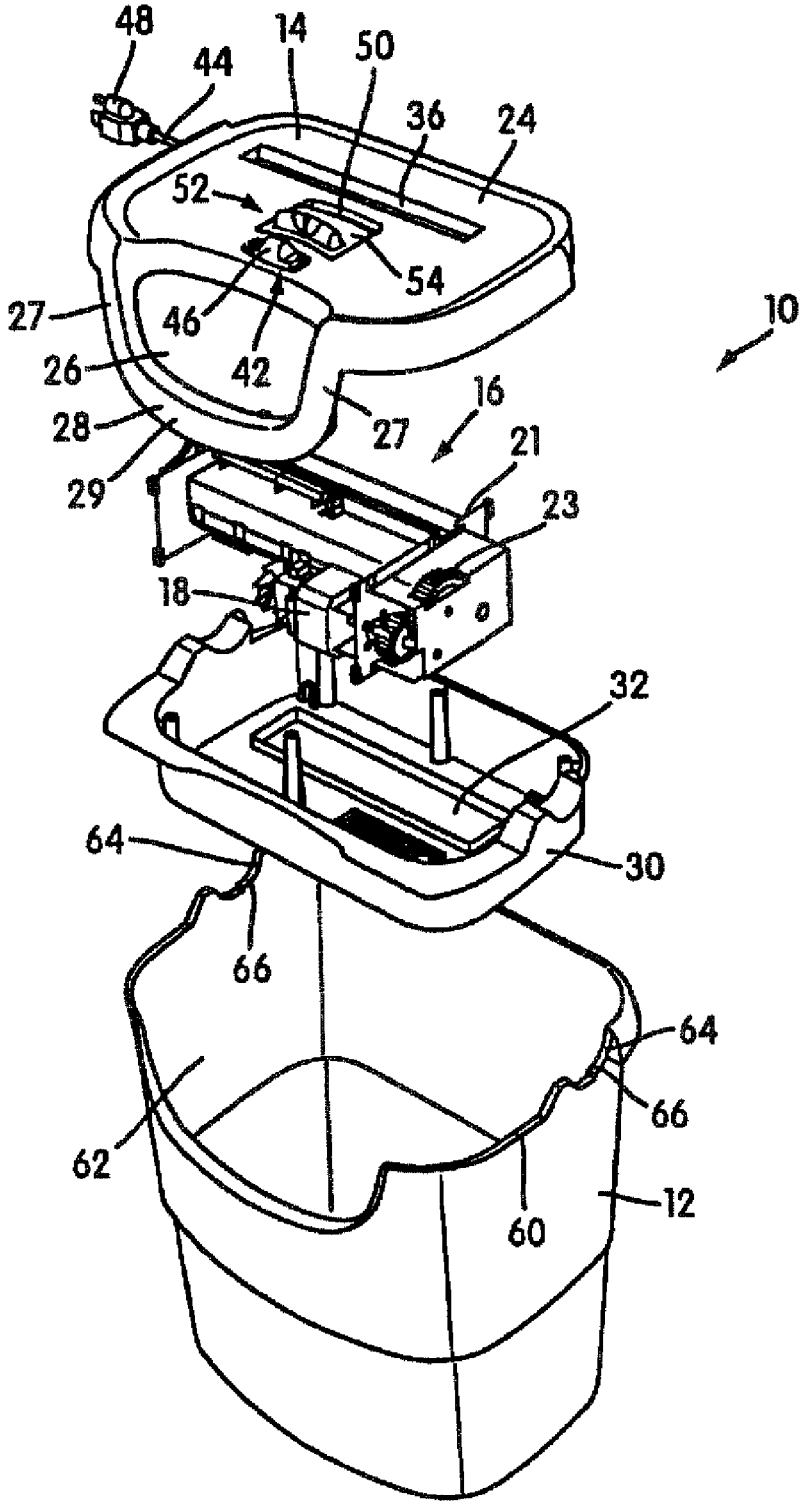
FIG. 2 is an exploded perspective view of the shredder of FIG. 1.

FIGS. 1 and 2 illustrate a shredder constructed in accordance with an embodiment of the present invention. The shredder is generally indicated at 10. The shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation. However, the shredder 10 may also be designed so as to sit atop a wide variety of standard waste containers, and the shredder 10 would not be sold with the container. Likewise, the shredder 10 could be part of a large freestanding housing, and a waste container would be enclosed in the housing. An access door would provide for access to and removal of the container. Generally speaking, the shredder 10 may have any suitable construction or configuration and the illustrated embodiment is not intended to be limiting in any way.

The shredder 10 includes a shredder mechanism 16 including an electrically powered motor 18 and a plurality of cutter elements (not shown). "Shredder mechanism" is a generic structural term to denote a device that shreds articles using cutter elements. Such shredding may be done in any particular way. The cutter elements are generally mounted on a pair of parallel rotating shafts (not shown). The motor 18 operates using electrical power to rotatably drive the shafts and the cutter elements through a conventional transmission 23 so that the cutter elements shred articles fed therein. The shredder mechanism 16 may also include a sub-frame 21 for mounting the shafts, the motor 18, and the transmission 23. The operation and construction of such a shredder mechanism 16 are well known and need not be described herein in detail. Generally, any suitable shredder mechanism 16 known in the art or developed hereafter may be used.

The shredder 10 also includes the shredder housing 14, mentioned above. The shredder housing 14 includes top wall 24 that sits atop the container 12. The top wall 14 is molded from plastic and an opening 26 is located at a front portion thereof. The opening 26 is formed in part by a downwardly depending generally U-shaped member 28. The U-shaped member 28 has a pair of spaced apart connector portions 27 on opposing sides thereof and a hand grip portion 28 extending between the connector portions 27 in spaced apart relation from the housing 14. The opening 26 allows waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 also includes a bottom receptacle 30 having a bottom wall, four side walls and an open top. The shredder mechanism 16 is received therein, and the receptacle 30 is affixed to the underside of the top wall 24 by fasteners. The receptacle 30 has an opening 32 in its bottom wall through which the shredder mechanism 16 discharges shredded articles into the container 12.

The top wall 24 has a generally laterally extending opening 36 extending generally parallel and above the cutter elements. The opening 36, often referred to as a throat, enables the articles being shredded to be fed into the cutter elements. As can be appreciated, the opening 36 is relatively narrow, which is desirable for preventing overly thick items, such as large stacks of documents, from being fed into cutter elements, which could lead to jamming. The opening 36 may have any configuration.

Though not shown, the top wall 24 may also have a switch recess 38 with an opening therethrough.

In accordance with at least one embodiment of the invention, the shredder includes an on/off switch 42. In accordance with at least that embodiment, the on/off switch may be overridden by the controller, e.g., when the capacitive sensor detects that an entity attempting to operate the shredder has a capacitance (and is of a corresponding size) that has been determined to not be permitted to operate the shredder mechanism, as explained herein.

The on/off switch 42 includes a switch module (not shown) mounted to the top wall 24 underneath the recess 38 by fasteners, and a manually engageable portion 46 that moves laterally within the recess 38. The switch module has a movable element (not shown) that connects to the manually engageable portion 46 through the opening 40. This enables movement of the manually engageable portion 46 to move the switch module between its states.

In the illustrated embodiment, the switch module connects the motor 18 to the power supply (not shown). Typically, the power supply will be a standard power cord 44 with a plug 48 on its end that plugs into a standard AC outlet. The switch 42 is movable between an on position and an off position by moving the portion 46 laterally within the recess 38. In the on position, contacts in the switch module are closed by movement of the manually engageable portion 46 and the movable element to enable a delivery of electrical power to the motor 18. In the off position, contacts in the switch module are opened to disable the delivery of electric power to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements in a reversing direction for clearing jams. In the illustrated embodiment, in the off position the manually engageable portion 46 and the movable element would be located generally in the center of the recess 38, and the on and reverse positions would be on opposing lateral sides of the off position.

Generally, the construction and operation of the switch 42 for controlling the motor 42 are well known and any construction for such a switch 42 may be used.

A sensor or switch, such as an optical sensor, may be provided in the throat of the shredder. This sensor detects the presence of paper or other objects being fed into the throat. When switch 42 is in the on position, the controller may be in a ready state enabling operation of the shredder mechanism, and activation of the optical sensor entering the throat—will activate the shredder mechanism—to begin shredding.

In accordance with at least one other embodiment of the invention, the shredder may not include an on/off switch. Rather, as explained herein, in accordance with at least that embodiment, the shredder may be operable at all times by an entity that has a capacitance (and, thereby, associated size) deemed sufficient to permit safe operation of the shredder.

For example, as long as it is plugged in or otherwise coupled to a power source, it may be ready to shred by inserting an object to activate a sensor in the throat. However, if a capacitive safety sensor adjacent the throat detects that an entity with a low capacitance (e.g., a child) is near the throat, it will cease operation until the entity distances himself from the throat.

As illustrated, in accordance with at least one embodiment, the top cover 24 may also include another recess 50 associated with a switch lock 52. This optional switch lock 52 may include a manually engageable portion 54 that is movable by a user's hand and a locking portion (not shown). The manually engageable portion 54 may be seated in the recess 50 and the locking portion may be located beneath the top wall 24. The locking portion may be integrally formed as a plastic piece with the manually engageable portion 54 and extend beneath the top wall 24 via an opening formed in the recess 50.

The switch lock 52 may be configured to cause the switch 42 to move from either its on position or reverse position to its off position by a camming action as the switch lock 52 is moved from a releasing position to a locking position. In the releasing position, the locking portion is disengaged from the movable element of the switch 42, thus enabling the switch 42 to be moved between its on, off, and reverse positions. In the locking position, the movable element of the switch 42 is restrained in its off position against movement to either its on or reverse position by the locking portion of the switch lock 52. See U.S. Pat. No. 7,040,559, incorporated herein by reference in its entirety for additional details regarding the optional switch lock.

In the illustrated embodiment and others, the shredder housing 14 is designed specifically for use with the container 12 and it is intended to sell them together. The upper peripheral edge 60 of the container 12 defines an upwardly facing opening 62, and provides a seat 61 on which the shredder 10 is removably mounted. The seat 61 includes a pair of pivot guides 64 provided on opposing lateral sides thereof. The pivot guides 64 include upwardly facing recesses 66 that are defined by walls extending laterally outwardly from the upper edge 60 of the container 12. The walls defining the recesses 66 are molded integrally from plastic with the container 12, but may be provided as separate structures and formed from any other material. At the bottom of each recess 66 is provided a step down or ledge providing a generally vertical engagement surface. This step down or ledge is created by two sections of the recesses 66 being provided with different radii.

The shredder 10 has a capacitive sensor configured to detect the presence of an entity attempting to operate the shredder because doing so provides an indication of the size, e.g., mass, of that entity. Because size is generally an indication of the age of the entity, i.e., smaller entities are generally younger and larger entities are generally older, the detected capacitance can be considered to be an indication of the relative age of the entity attempting to use the shredder. As a result, by predetermining a cut-off for the minimum age of an entity that may operate the shredder safely and determining a range or approximation of the associated capacitance of such entities, a predetermined capacitance value may be identified (however, exceptions are possible, e.g., smaller adults and larger youth). As a result, operation of the shredder may be selectively enabled/disabled based on the capacitance detected by the capacitive sensor working in cooperation with the controller.

Moreover, in accordance with at least one embodiment of the invention that includes an on/off switch, the operation of that switch may be overridden based on the detected capacitance of the entity attempting to utilize the shredder.

As a result, of these configurations utilizing capacitive sensors in combination with controllers, the unsafe operation of a shredder by a child may be prohibited. Moreover, because there is a risk of family pet's being injured by shredder accidents wherein the pet attempts to insert a body part into the opening 36 of the shredder, the combined capacitive sensor and controller operation provides an additional safeguard for pet safety. This is because the relative size of a family pet is generally similar to that of a child than an adult. As a result, the inadvertent operation of a shredder conventionally activated by a dog licking the cutting portions of the shredder would be prohibited.

Regardless of the embodiment, the capacitive sensor may be implemented in various ways, such as is described in further detail below. For further examples of shredders on which a capacitive sensor may be used, reference may be made to U.S. patent application Ser. No. 10/828,254 (filed Apr. 21, 2004), Ser. No. 10/815,761 (filed Apr. 2, 2004), and Ser. No. 10/347,700 (filed Jan. 22, 2003), each of which is hereby incorporated into the present application by reference. Generally, the capacitive sensor may be used with any type of shredder, and the examples identified herein are not intended to be limiting.

Figure 3:
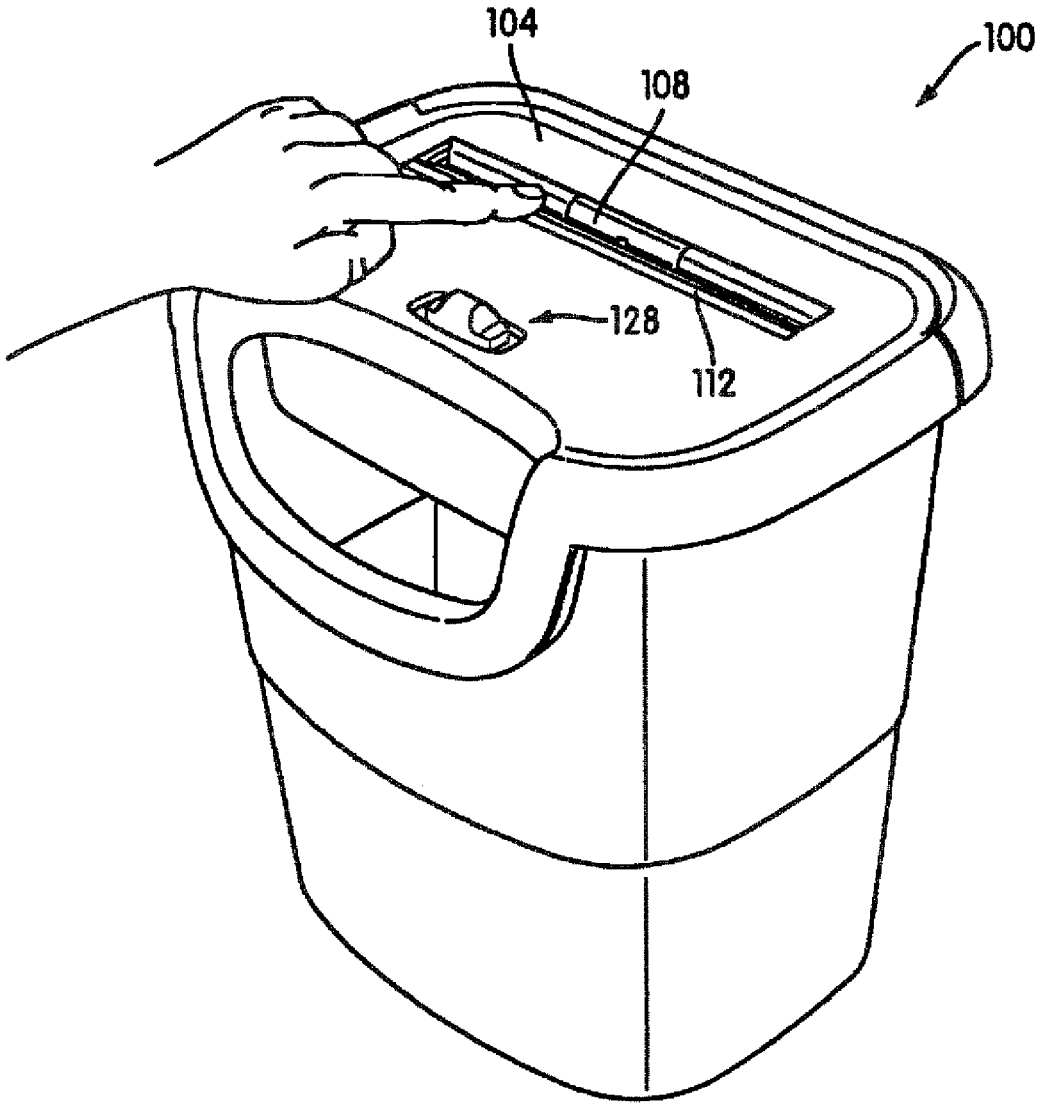
FIG. 3 is a perspective view of a shredder constructed in accordance with at least one embodiment of the present invention.

FIG. 3 is a perspective view of a shredder 100 constructed in accordance with at least one embodiment of the present invention. As explained above, the shredder 100 incorporates a capacitive sensor. The illustrated capacitive sensor detects the presence of a person or thing without requiring physical contact. The capacitive sensor includes a conductor/contact plate 112 connected to a circuit, such as those shown in FIGS. 8-9 and 14-20. The conductor 112 serves as the first plate of a capacitor, while the person or thing to be detected serves as the second plate thereof. As the distance between the conductor 112 and the person or thing decreases, the mutual capacitance therebetween increases. This increase in capacitance results in increased signal levels in the sensor, which levels can be used to detect the capacitance of the person or thing.

It is to be appreciated that capacitance depends in part on the dielectric constant of the second plate of a capacitor. A higher dielectric constant translates into a larger capacitance. Therefore, the capacitive sensor of the shredder 100 can detect the capacitance of a nearby animate or inanimate entity provided that its respective dielectric constant is sufficiently high. Because human beings and various animals have relatively high dielectric constants, they are detectable by the capacitive sensor. Inanimate objects with relatively high dielectric constants also are detectable. Conversely, objects with low or moderate dielectric constants, such as paper, are not detectable.

In accordance with at least one embodiment wherein the safety sensor is located near the throat of the shredder, there may be more than two, e.g., three, ranges of detectable capacitance effecting operability of the shredder. For example, a highest range of capacitance may correspond to no prohibition on shredder functionality because the capacitance detected is within a range associated with an adult operator. A middle range may correspond to a child operator; therefore, that range of detected capacitance would correspond to a prohibition or lack of enablement for the shredder operation. A third range, the lowest detected range of capacitance may correspond to background capacitance or capacitance associated with insertion of material in the shredder by someone who is standing, for example, unusually close to the throat of the shredder.

Therefore, in accordance with at least one embodiment of the invention, the capacitive sensor may prohibit operation of the shredder unless a detected capacitance meets a predetermined level (i.e., one associated with the would be operator being of sufficient maturity to operate the shredder safely).

Figure 30:
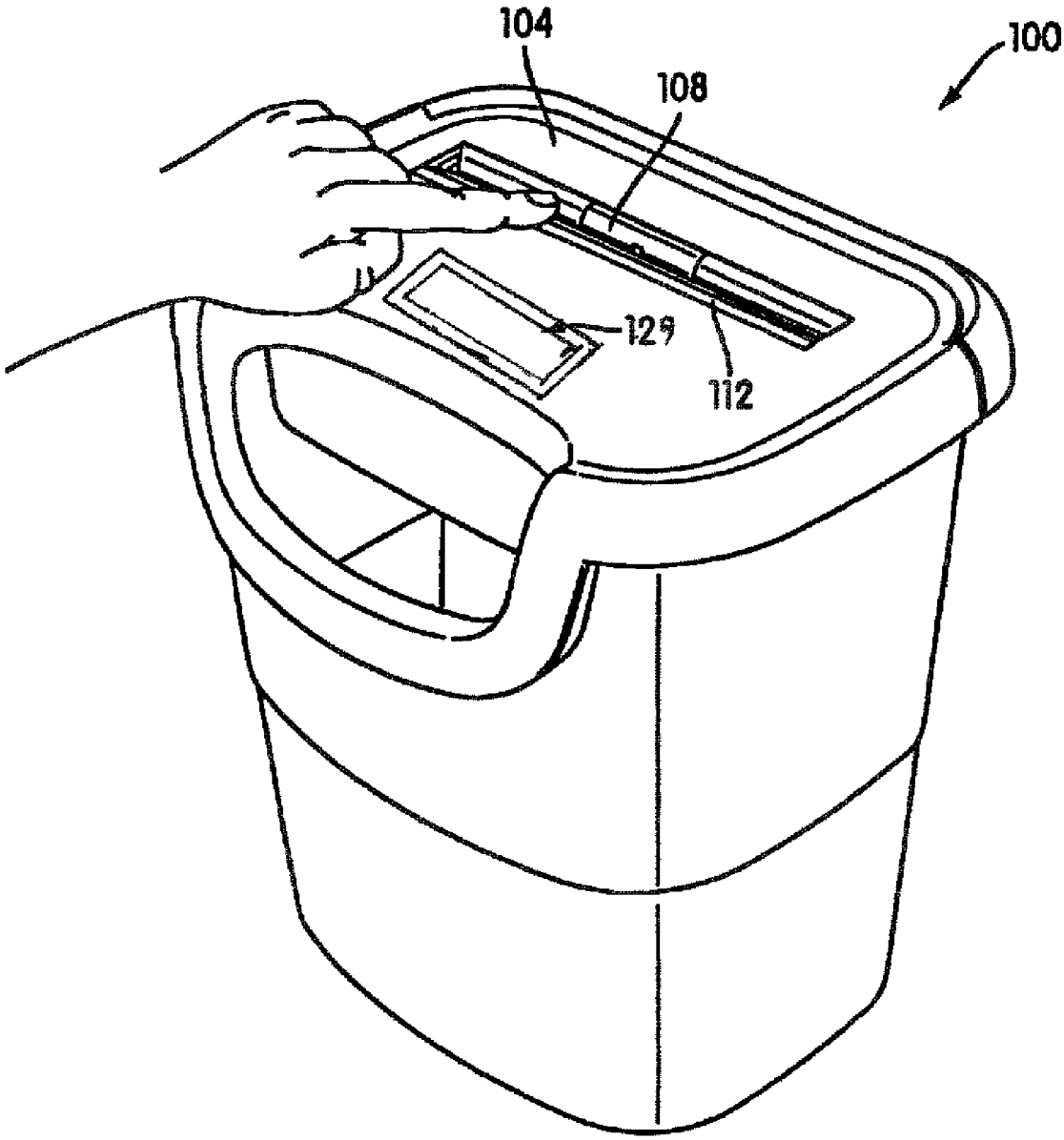
FIG. 30 is a perspective view of a shredder constructed in accordance with at least one embodiment of the present invention.

FIG. 30 shows a shredder with a capacitive power switch/sensor 129, as an example. In accordance with at least this embodiment, the sensor 129 could be used as a power switch (i.e., an activation switch or an on/off switch) mounted to the housing exterior in place of a conventional mechanical power switch (e.g., switch 128 in FIG. 3). Thus, in accordance with at least this embodiment, if a person of larger mass (e.g., an adult) were to touch the sensor 129, the detected capacitance would be high enough that the shredder mechanism would be operative (e.g., by enabling power to flow to the drive motor). Conversely, if a person of smaller mass (e.g., a child) were to contact the sensor 129, the detected capacitance would be too low, and the sensor would leave the shredder in a disabled or inoperative state (e.g., it would not allow power to flow to the drive motor).

In accordance with at least another embodiment, the capacitive sensor may remain in the shredder throat 108, as illustrated, for example, in FIG. 3. Normally, when no entity is at or in the throat, the shredder mechanism 16 may be in a ready or enabled state. That is, the sensor would allow electricity to flow so that the shredder mechanism will operate upon triggering of the paper detection sensor typically found inside the throat. If a person of small mass, with a low detected capacitance, is detected in proximity to or contacts the throat, the sensor may responsively disable operation of the shredder mechanism 16 by interrupting the power flow to the drive motor.

However, if a person of larger mass, with a higher detected capacitance, is so detected, the sensor may be configured to take no action. The assumption is that a person of larger mass is of sufficient maturity to understand the hazards posed by the shredder blades, and thus, there is less concern with that person being near the throat.

Thus, in accordance with at least this embodiment, the sensor in the throat may be used to discriminate between large and small persons, and prevent shredder operation when persons of small mass are near the throat, but allow larger mass persons to accept the risk of being near the throat.

Alternatively, in accordance with at least one embodiment of the invention, the capacitive sensor may enable operation of the shredder only when a detected capacitance meets a predetermined level (i.e., one associated with the would be operator being of sufficient maturity to operate the shredder safely). Additional details regarding the capacitive sensor are provided herein in connection with FIGS. 16-22.

The shredder 100 includes a shredder housing 104, an opening 108, and a control switch 128 with on, off, and reverse positions. A shredder mechanism, such as the one described above, is located beneath the opening 108 so that documents can be fed into the shredder mechanism through the opening 108.

The conductor 112 can be, for example, a strip of metal, foil tape (e.g., copper tape), conductive paint, a silk-screened conductive ink pattern, or another suitable conductive material. As shown in FIG. 3, the conductor 112 is a 9-inch by 1-inch capacitive sensing strip that is affixed to the housing 104 near the opening 108. As such, when a person or thing nears the opening 108 and thus the cutter elements of the shredding mechanism of the shredder 100, the capacitance between the conductor 112 and the person or thing increases, resulting in an increase in the signal level used for detection, as will be described below. To ensure that the switch is sensitive enough to detect the person or thing through multiple sheets of paper, the conductor 112 may extend into the opening 108 to increase the overall surface area of the conductor 112 and thus the amount of capacitance between the conductor 112 and the nearby person or thing. The conductor 112 optionally can be covered by non-conductive plastic, for example, thus concealing the switch from a user of the shredder 100. In addition, to increase sensitivity of the switch, such non-conductive plastic can be covered with a conductive material, such as metal foil.

Though not illustrated in FIG. 3, the shredder 100 can include a sensor light, an error light, and/or a light indicative of normal operation. The sensor light, which can be an LED, is illuminated when a person or thing is detected. The error light, which also can be an LED, is illuminated when a person or thing is detected, and optionally under other conditions (e.g., the shredder container is not properly engaged with the shredder 100, or the shredder mechanism has become jammed). These lights, however, are not necessary, and are only optional features.

FIGS. 4-7 are cross-sectional views each showing a shredder housing 104, opening 108, cutting elements 132, and a conductor configuration for a sensor in accordance with various embodiments of the present invention. The conductor configurations can include conductor(s) of different areas to tailor the amount of capacitance and thus the signal level produced when a person or thing nears the shredder. Where multiple conductors are employed, the distance therebetween may be designed also to tailor the amount of capacitive coupling and thus the capacitance produced.

Figure 4:
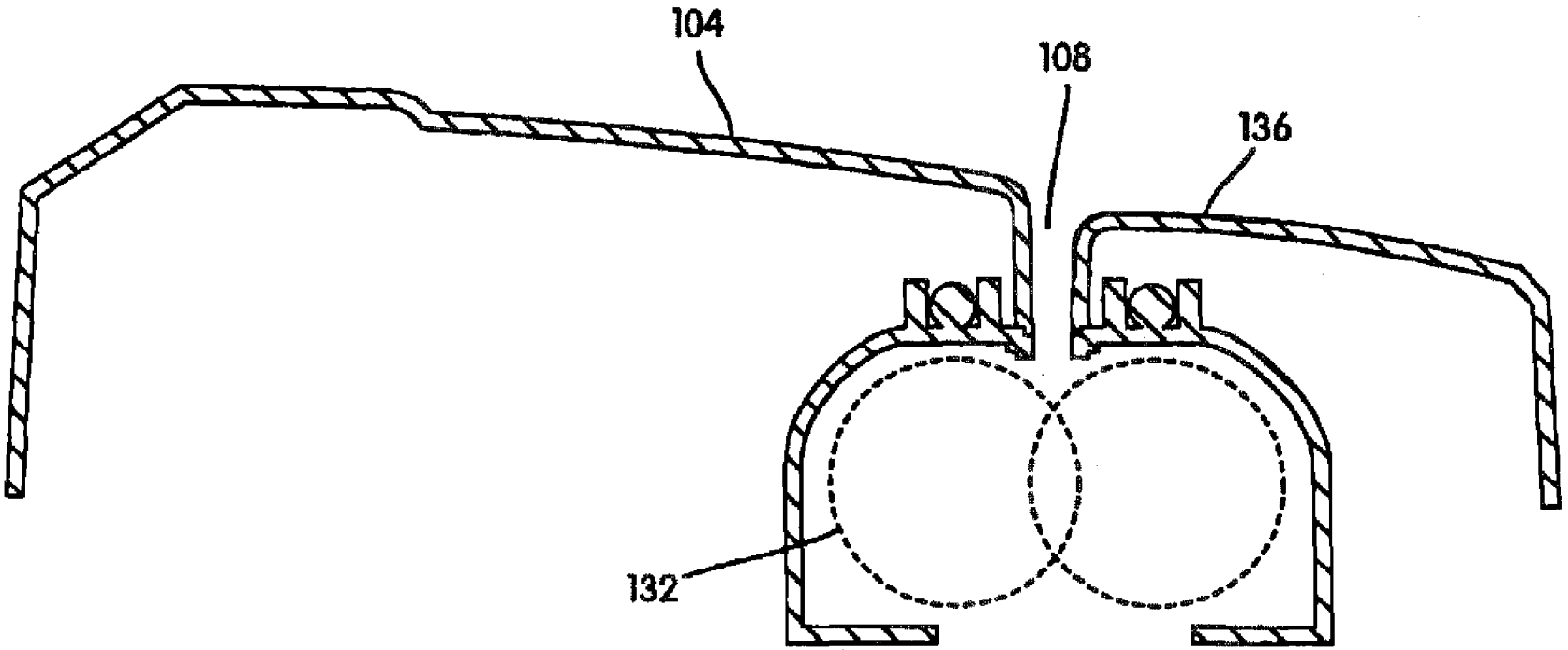
FIGS. 4-7 are cross-sectional views each showing a shredder housing, opening, cutting elements, and conductor configuration for a sensor in accordance with various embodiments of the present invention.

In FIG. 4, the conductor 136 comprises a conductive material embedded within the upper wall of the housing 104 beneath the upper surface partially into the opening 108. The conductor 136 also is optionally embedded in the wall defining the opening 108 and extends along it for a portion.

Figure 5:
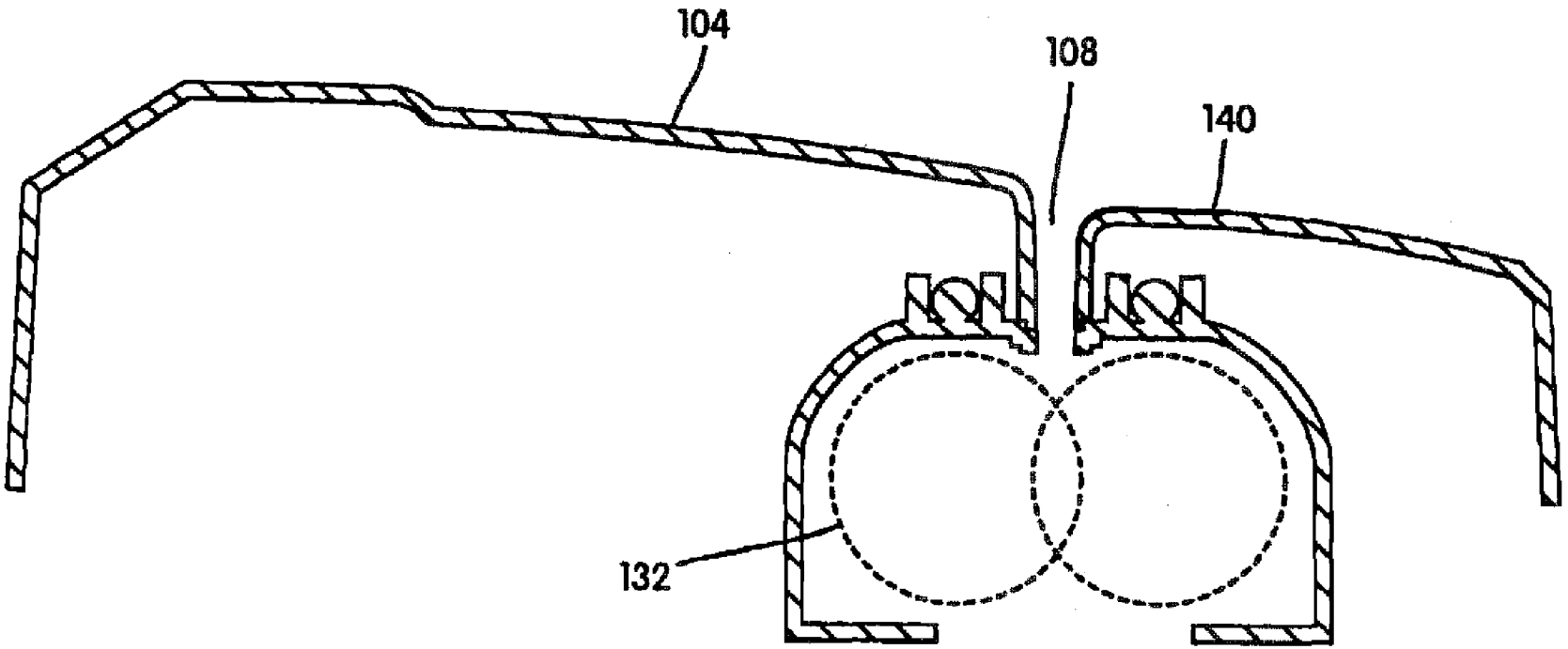

In FIG. 5, the conductive material of the conductor 140 covers an upper surface portion of the housing 104, extends substantially into the opening 108, and curves around a flange of the housing 104 so as to cover an inside surface portion of the housing 104. For a conductor 140 that has a noticeable amount of thickness, the top portion of the upper surface where the conductor 140 is mounted may be recessed.

Figure 6:
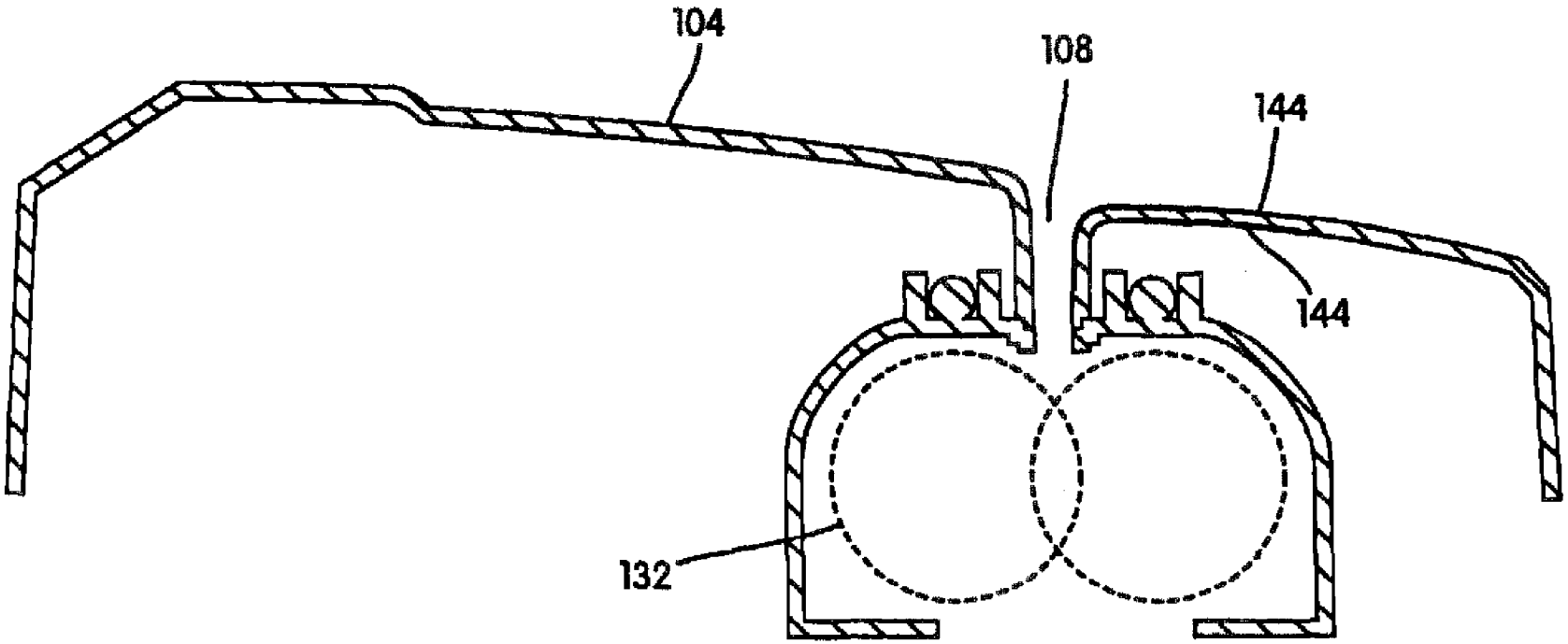

The conductor 144 of FIG. 6 includes two conductive portions respectively affixed to outside and inside surface portions of the housing 104. Such use of multiple portions increases the surface area of the capacitor, as well as the capacitive coupling, capacitance, and signal level produced when a person or thing nears the conductive portions.

Figure 7:
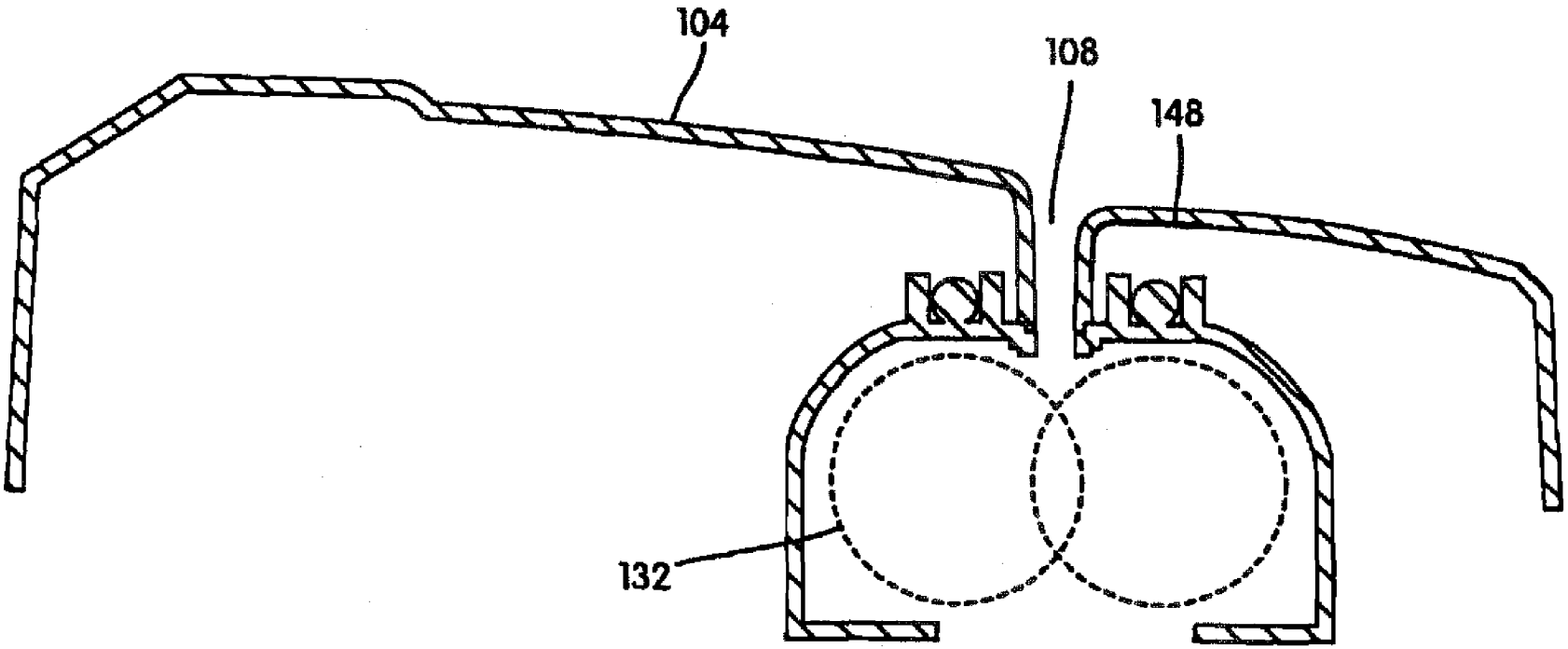

The conductor 148 of FIG. 7 comprises a conductive material on an inside surface portion of the housing 104. This is desirable for concealing the conductor 148 without adding the manufacturing step of embedding the conductor in a housing wall, such as is shown in FIG. 4. It is to be appreciated that the conductors of FIGS. 4-7 may be of any suitable configuration, and the examples illustrated are in no way intended to be limiting.

Figure 8:
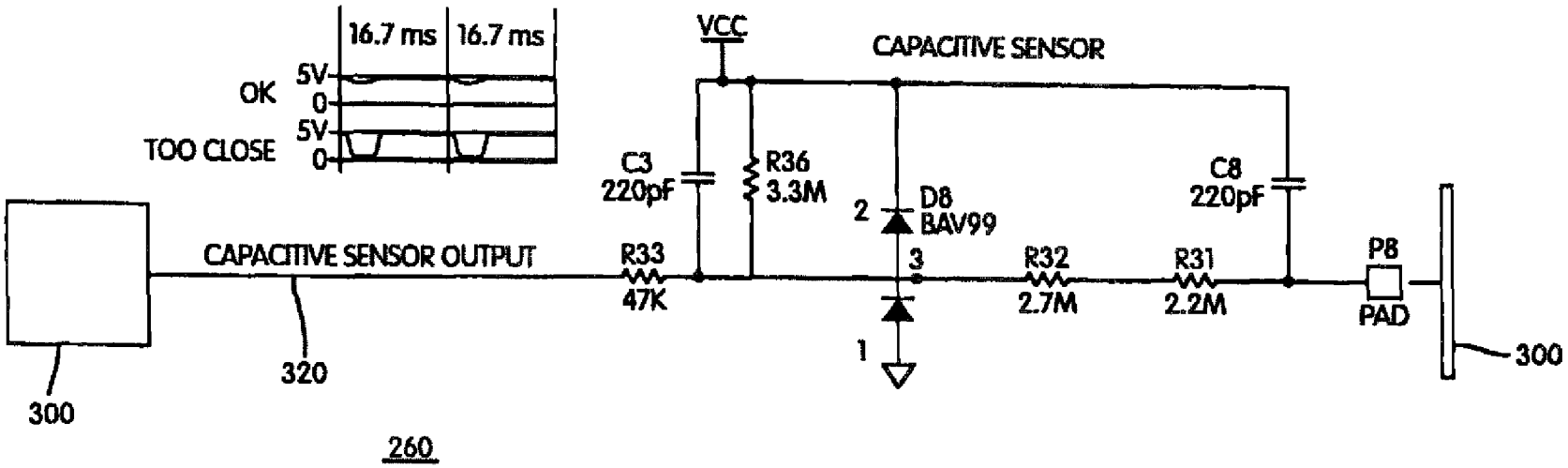
FIGS. 8 and 9 illustrate example capacitive sensor circuits according to respective embodiments of the present invention.
Figure 9:
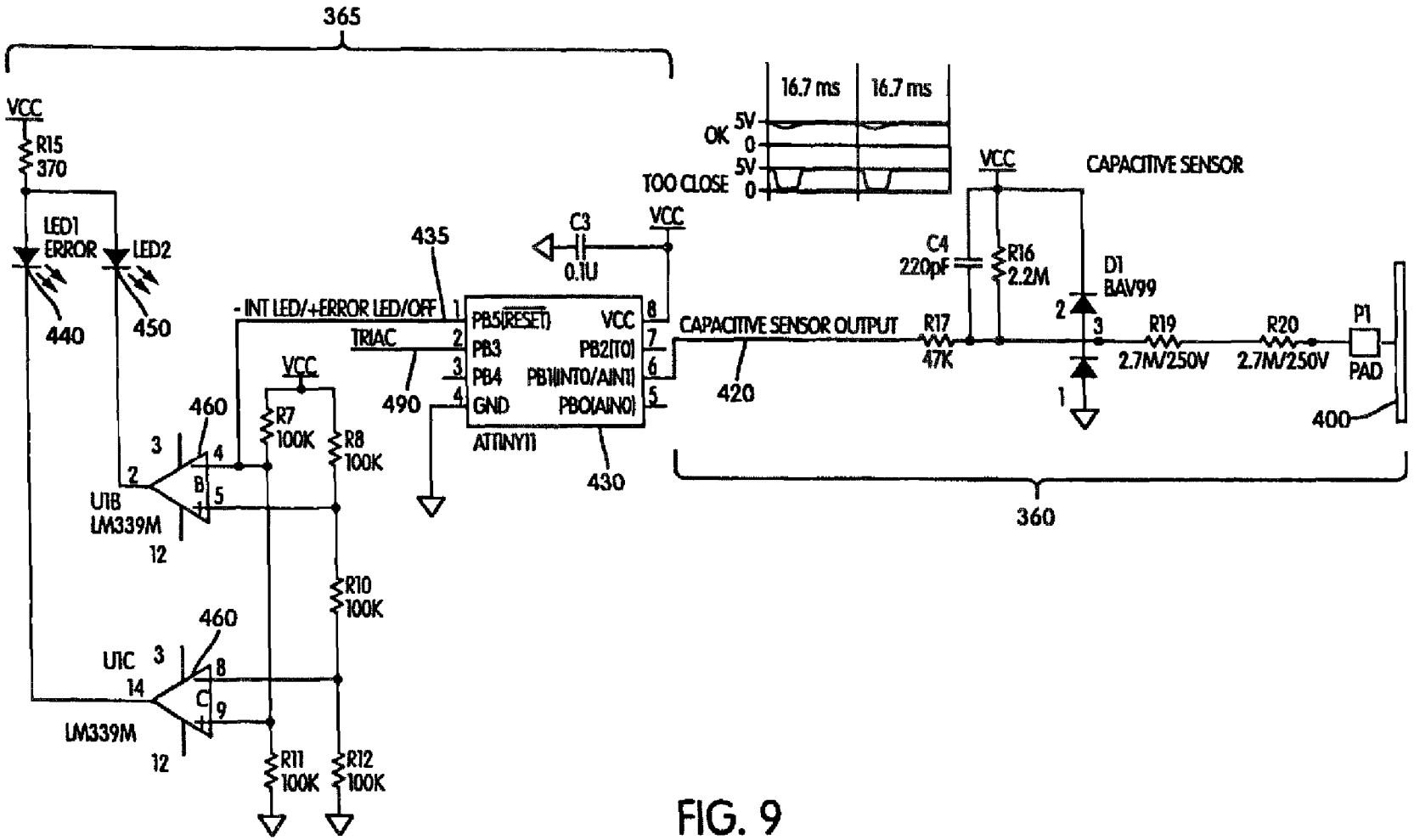

A conductor or conductive material such as described above in connection with FIGS. 3-7 is typically connected to circuitry on a circuit board. FIGS. 8 and 9 illustrate example capacitive sensor circuits according to respective embodiments of the present invention. The example circuits may be incorporated into the overall circuit design of a shredder, and are in no way intended to be limiting.

In FIG. 8, the capacitive sensor circuit 260 includes a conductor 300 that can have a configuration such as shown above or another suitable configuration. The conductor 300 is connected to a pad P8, which is in turn connected to circuit loops including capacitors C8 and C9, resistors R31, R32, and R36, and a high-speed double diode D8. The loops are connected to a voltage supply Vcc, circuit ground, and a resistor R33. The voltage supply Vcc is connected to the AC line voltage of the shredder, and a negative regulator can generate −5 volts for the circuit ground. The capacitive sensor output 320 may be in turn coupled as an input to a controller 330, such as a microprocessor or discrete circuit components (e.g., comparators, transistors), which takes appropriate action in response to signal levels at the output 320. Such a controller 330 may also be a relay switch that opens to disable the delivery of power to an element (e.g., the motor of the shredder mechanism) and closes to enable the delivery of power. It is to be appreciated that "controller" is a generic structural term that denotes structure(s) that control one or more modules, devices, and/or circuit components.

The principles of operation of the circuit 260 will be readily understood by those conversant with the art. When a person or thing moves close to the conductor 300, the increased capacitance therebetween causes the amplitude of the sinusoidal waveform at the output 320 to increase by a voltage sufficient to indicate the presence of the person or thing. Based on the increased signal level, the controller 330 can, for example, disable the cutting elements of the shredder, illuminate a sensor or error light, and/or activate an audible alert.

FIG. 9 illustrates a capacitive sensor circuit 360, as well as control and illumination circuitry 365. The capacitive sensor circuit 360 includes a conductor 400 that can have a configuration such as shown above or another suitable configuration. The conductor 400 is connected to a pad P1, which is in turn connected to series resistors R19 and R20. The resistor R19 is connected to circuit loops including a capacitor C4, a resistor R16, and a high-speed double diode D1. The loops are connected to a voltage supply Vcc, circuit ground, and a resistor R17. The voltage supply Vcc is connected to the AC line voltage of the shredder, and a negative regulator can generate −5 volts for the circuit ground. The capacitive sensor output 420 is coupled as an input to a controller 430, which can be, for example, a simple analog circuit or an ATtiny11 8-bit microcontroller offered by Atmel Corporation (San Jose, Calif.).

The principles of operation of the circuitry of FIG. 9 will be readily understood by those conversant with the art. When a person or thing moves close to the conductor 400, the increased capacitance therebetween causes the amplitude of the sinusoidal waveform at the output 420 to increase by a voltage sufficient to indicate the presence of the person or thing. Based on the increased signal level, the controller 430 sends appropriate control signals. For example, the controller 430 sends a control signal 490 to cut off power (such as supplied by a triac) to the motor that drives the cutting elements of the shredder, and a control signal 435 to illuminate a sensor LED 450 or error LED 440 coupled to comparators 460.

Embodiments of the present invention may be incorporated, for instance, in a shredder such as the PS80C-2 shredder of Fellowes, Inc. (Itasca, Ill.). If desired, existing shredder designs may be adapted, without major modification of existing modules, to incorporate capacitive sensing circuitry.

Figure 10:
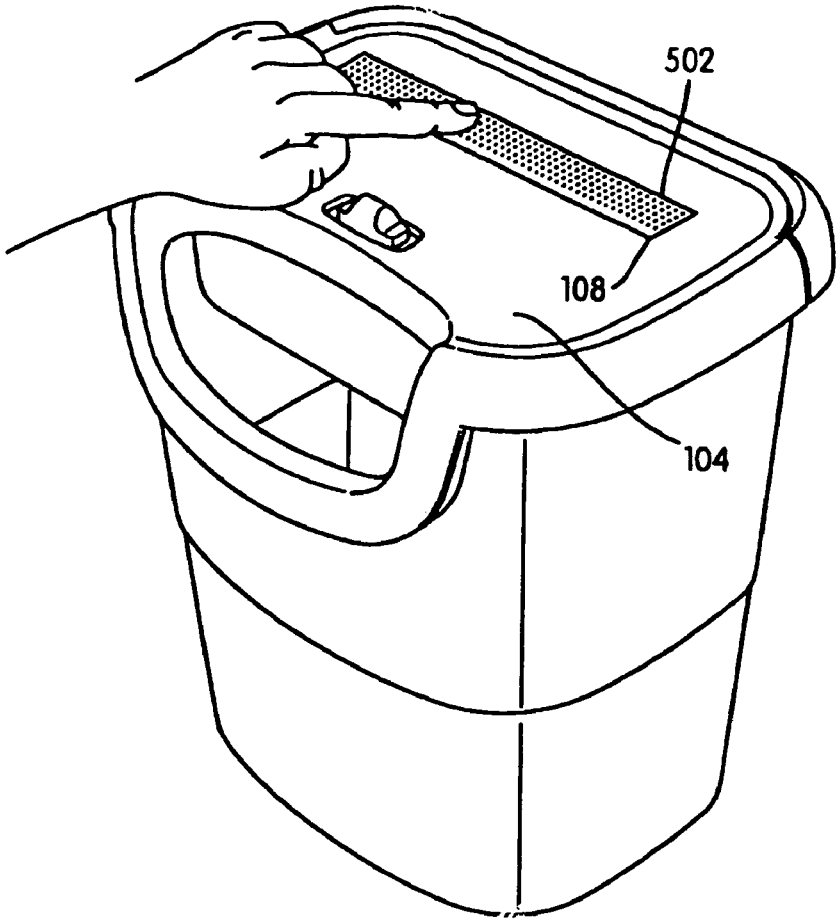
FIGS. 10 and 10A are illustrations of a switch according to the present invention.
Figure 10A:
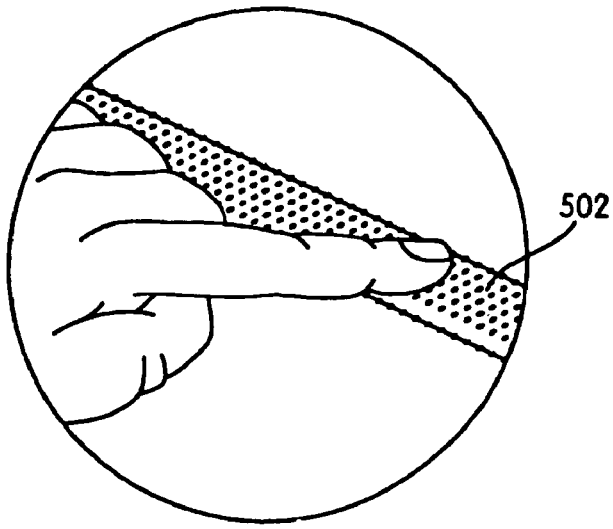
Figure 11:
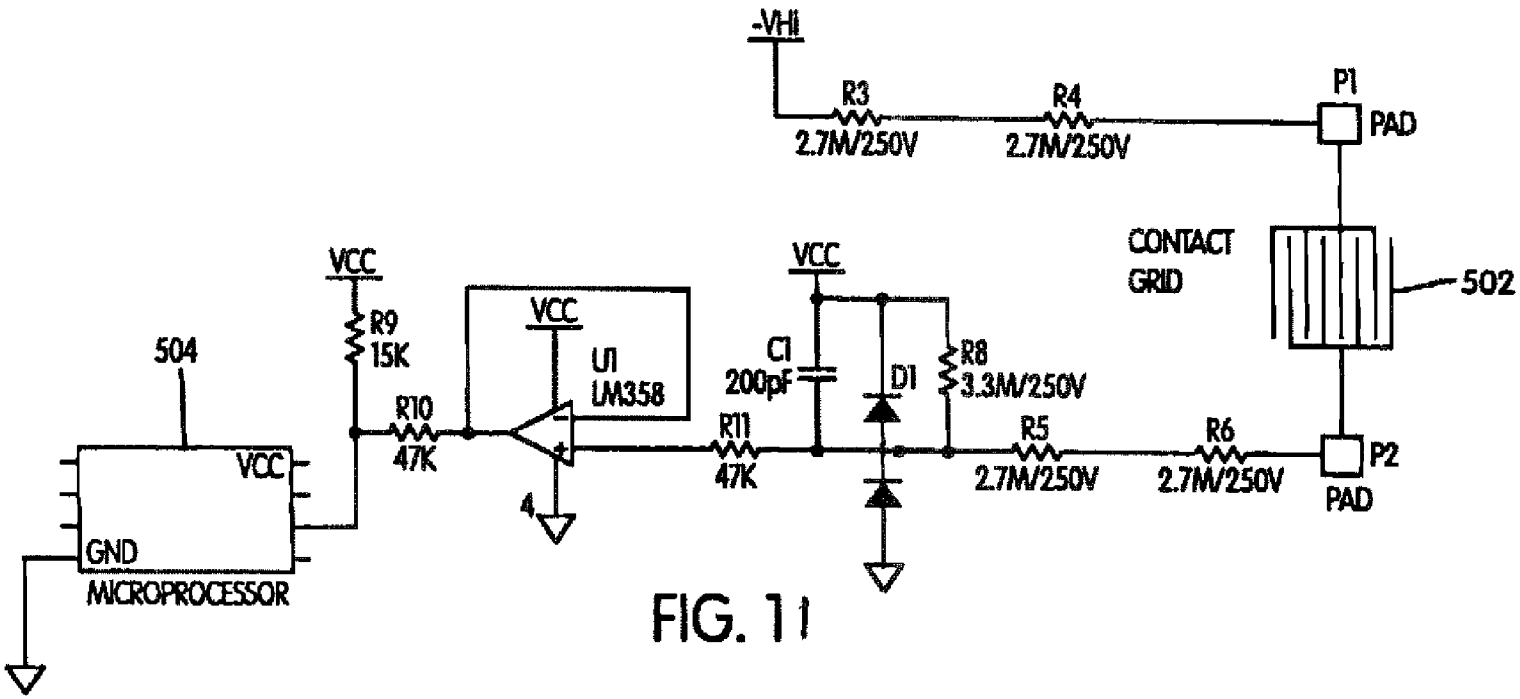
FIG. 11 is a schematic diagram of an example of an electronic circuit for controlling the operation of a shredder in accordance with the embodiment of FIG. 11.

FIG. 10 illustrates an additional embodiment of a switch in accordance with the present invention, and FIG. 10A is a magnified view isolating the switch portion. The structure of the embodiment of FIG. 10 is similar to that of the embodiment of FIG. 3. A switch 502 is affixed to the housing 104 near to the opening 108. The switch is configured to sense contact by a change in resistance, for example as a result of contact with the switch by a person's hand.

Figure 12:
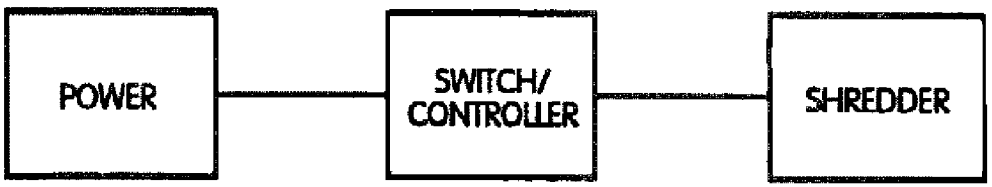
FIG. 12 is a schematic diagram of an electrical connection used in an embodiment of the present invention configured for retrofitting to an existing shredder.

In one example, the switch includes a conductive grid, separated into two mutually adjacent conductors, this embodiment is represented schematically in FIG. 12 along with a control circuit. In a particular implementation, VHi is set to be nominally 20V less than Vcc. Pads P1 and P2 provide connectivity to the remainder of the circuit. The resistors R3-R6 are selected to have a large resistance, thereby limiting the current flowing through the circuit when activated. When a user's hand comes into contact with the grid, the circuit is completed and a current flows. The amplifier U1A (which may be, by way of example, an LM358, available from National Semiconductor), buffers the analog voltage produced, and passes it to an analog input of the microprocessor 504. The resistors R8, R9, R10 can be varied in order to change a sensitivity of the system, as desired.

The microprocessor can be selected to control the shredder in response to the signal from the amplifier U1A. In particular, the microprocessor can be set to control, for example, a triac that in turn controls the power to the shredder motor so that the blades stop when the switch 502 is contacted. Further, as noted above, a warning light or LED may be activated to inform the user why the motor has been deactivated.

Because the total resistance of the switch grid 502 can change, for example due to build up of dirt, the signal level can vary. Likewise, a user with moist fingers will provide less resistance than one with dry fingers, etc. Therefore, in one embodiment, the shredder's control software can include routines for monitoring nominal resistance over time, and adjust a threshold accordingly. Similarly, one embodiment of the present invention allows for monitoring a change in the signal rather than a strength of the signal, thereby discriminating between a slow build-up of dirt and a transitory contact. Finally, in one embodiment, as the measured nominal resistance falls below a predetermined level, an indicator, e.g., an LED, can be used to inform the user that the grid should be cleaned.

In another alternate embodiment, the switch may be a retrofit device. As shown schematically in FIG. 14, the retrofit device is interposed between the shredder and the power supply. The shredder is plugged into a controller rather than directly into a wall power supply. During normal operation, the retrofit device acts as a pass-through for power from the wall outlet to the shredder, and the shredder will operate substantially as it does when normally plugged into the wall. However, when the switch is activated, a controller, which may be, for example, similar to the one illustrated in FIG. 13, can cut off power to the shredder and/or provide an indication of a fault condition.

Figure 13:
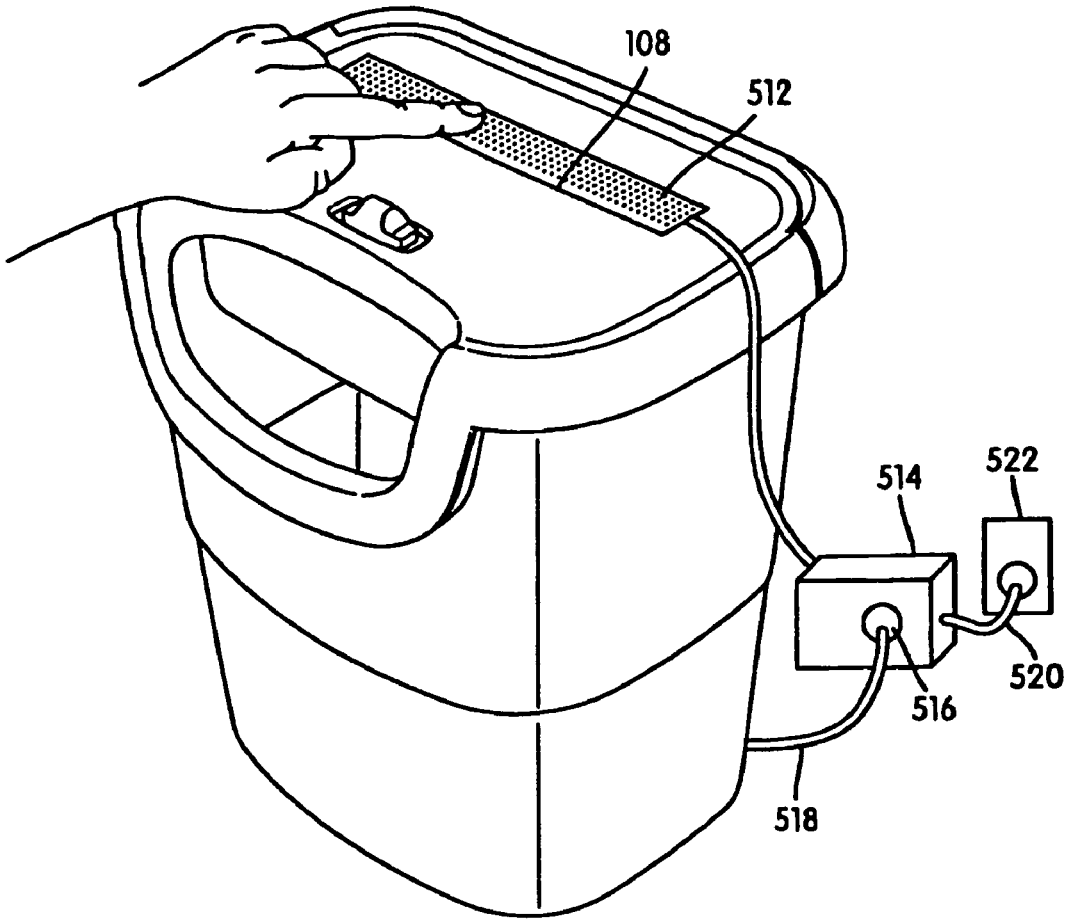
FIGS. 13 and 13A are illustrations of a retrofit embodiment of the present invention.
Figure 13A:
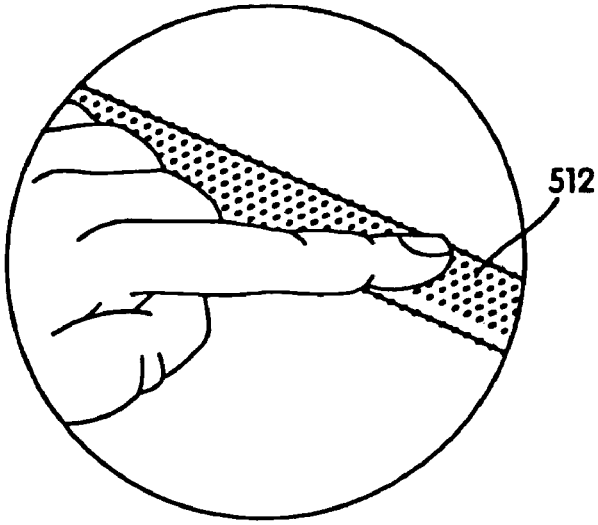

As illustrated in FIG. 13 and 13A, the retrofit switch 512 itself may be a resistance sensitive switch, a capacitance sensitive switch or a pressure sensitive switch such as a membrane or foil switch, for example. The switch is affixed, permanently or removably, by use of an adhesive or a fastener to a position proximate the opening 108. It is electrically connected to a controller 514 which may be entirely separate, or may simply be a small package that can be affixed to the shredder housing 104. As noted above, the controller includes a receptacle 516 for the power cord 518 of the shredder, and will generally include its own power cord 520 for engaging a wall outlet 522 or other power source.

In accordance with at least one embodiment of the invention, a shredder can provide two or more sensitivity settings for capacitive sensing. The settings can be selectably enabled by a user and tailored to detect, e.g., toddlers or pets. Moreover, in accordance with at least one embodiment of the invention, the predetermined capacitance level cut-off may be set by the owner of the device to enable operators of sufficient age and maturity but insufficient size and capacitance, to operate the shredder.

In accordance with at least on embodiment employing a capacitive sensor, objects may be distinguished based on load times. For example, a smaller capacitive load results in a shorter load time than a large capacitance. Thus, by measuring (e.g., with a microprocessor) differences in load times resulting from capacitive loads near a sensor, various objects can be distinguished.

Thus, in such an embodiment, the capacitive sensor and associated circuitry may be configured to detect and operate to prevent living material, e.g., a child's finger, a pet's tongue, etc., from entering the cutting mechanisms of the shredder. Moreover, in accordance with at least one embodiment of the invention, the capacitive sensor and associated circuitry may be configured to differentiate between the size of the object, e.g., an operator, near the mechanism.

In its most basic form, the capacitive sensor may detect the mere presence of a person near the throat of the shredder. Thus, as illustrated in FIG. 3, in accordance with at least one embodiment of the invention, the conductor/contact plate 112, comprised of a strip of metal approximately 8" by 0.5", may be placed on the interior of the shredder housing 104.

Figure 16:
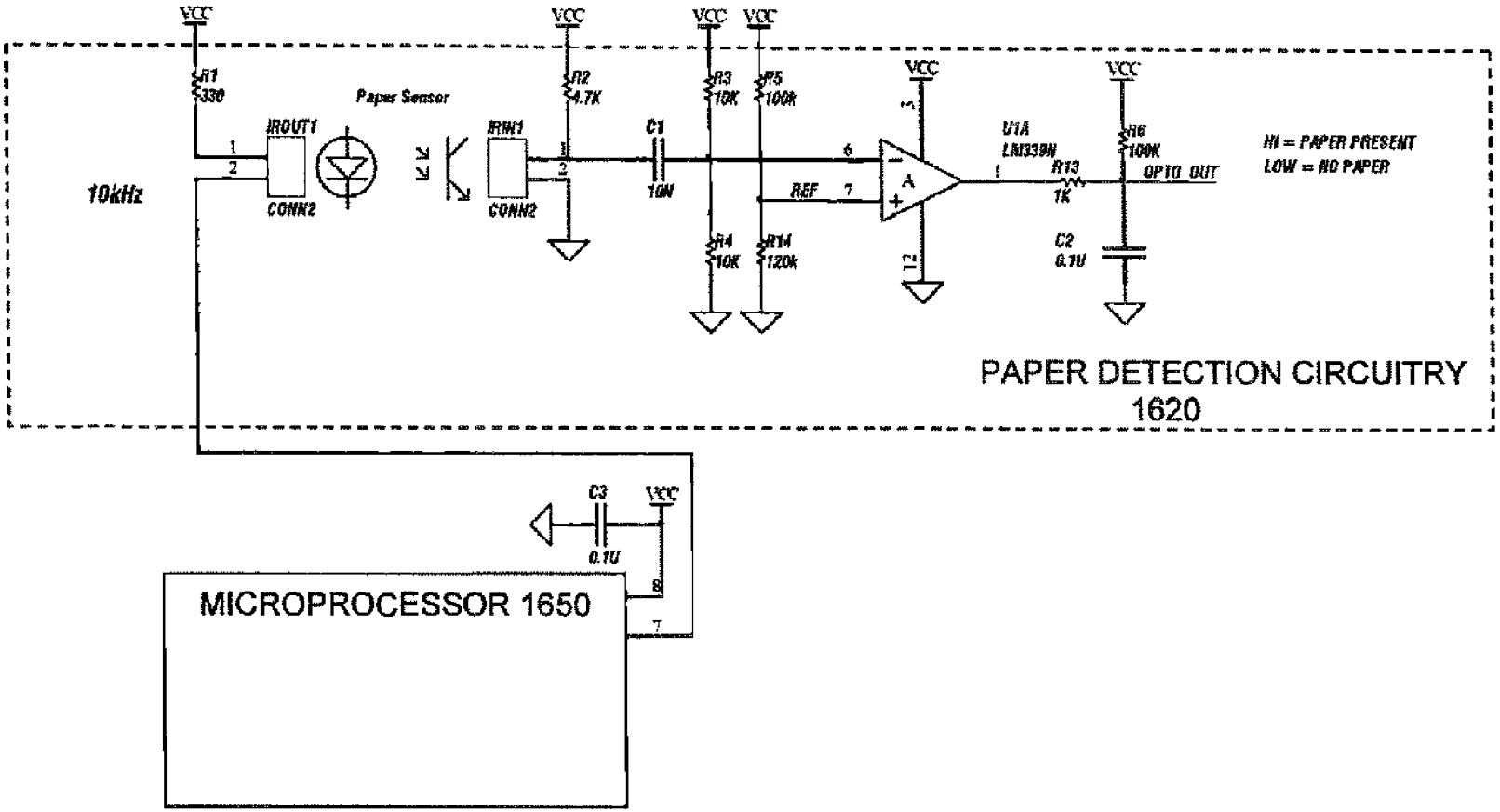

In accordance with at least this embodiment, the conductor/contact plate 112 may be connected to a capacitive sensor circuit 1600 illustrated in FIG. 16; in turn that sensor circuit 1600 may be connected to the driver for a triac on a PSC80-2. Thus, the conductor/contact plate 112 may be driven by the line voltage through a high impedance. Therefore, the capacitance of a person's body will cause the voltage at the gate of Q2 to fall when close to the contact strip. Eventually, this operation turns on Q1, the red LED, and the optocoupler. The optocoupler subsequently shorts the base of the triac driver causing the motor to turn off.

Figure 17:
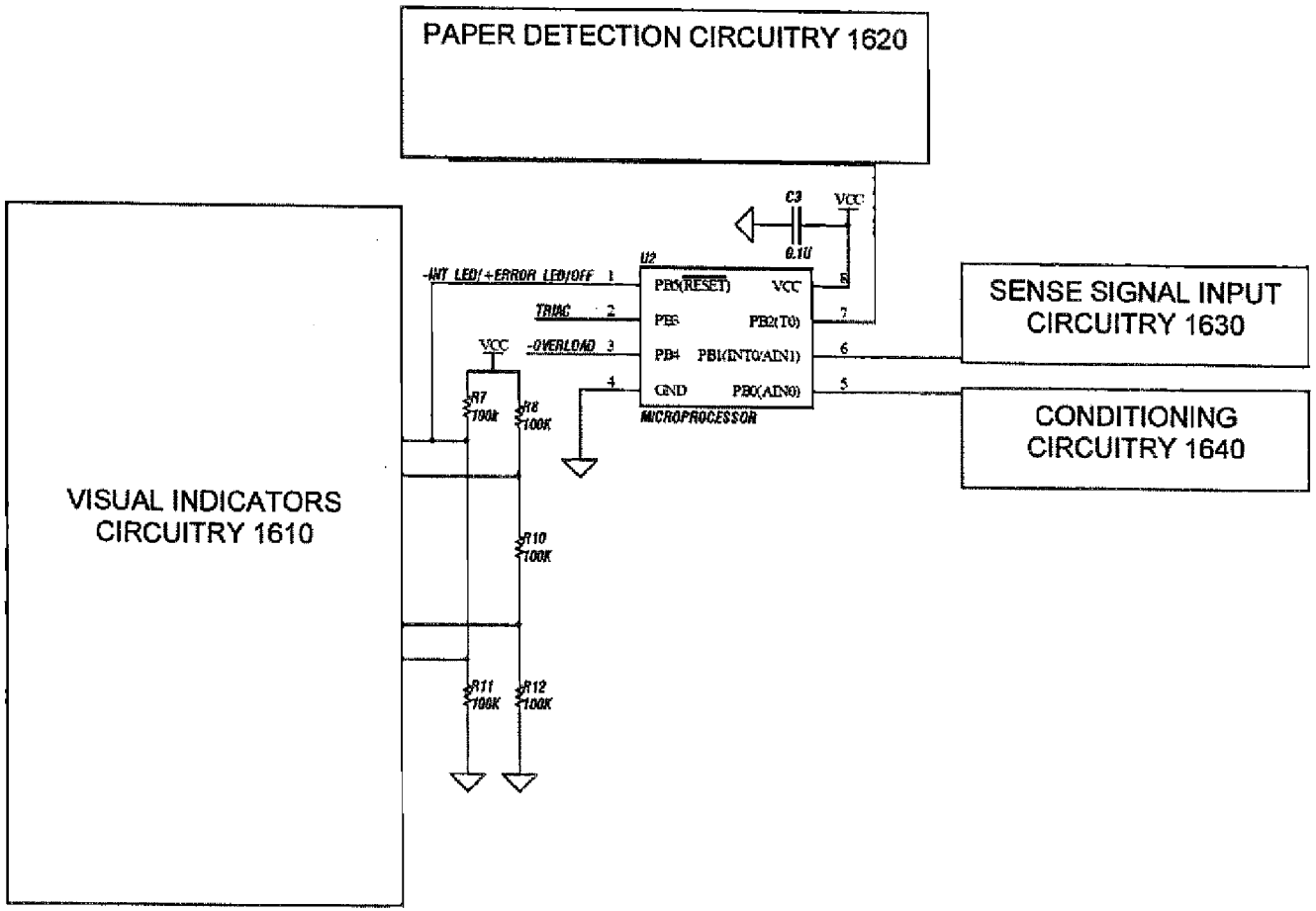
Figure 18:
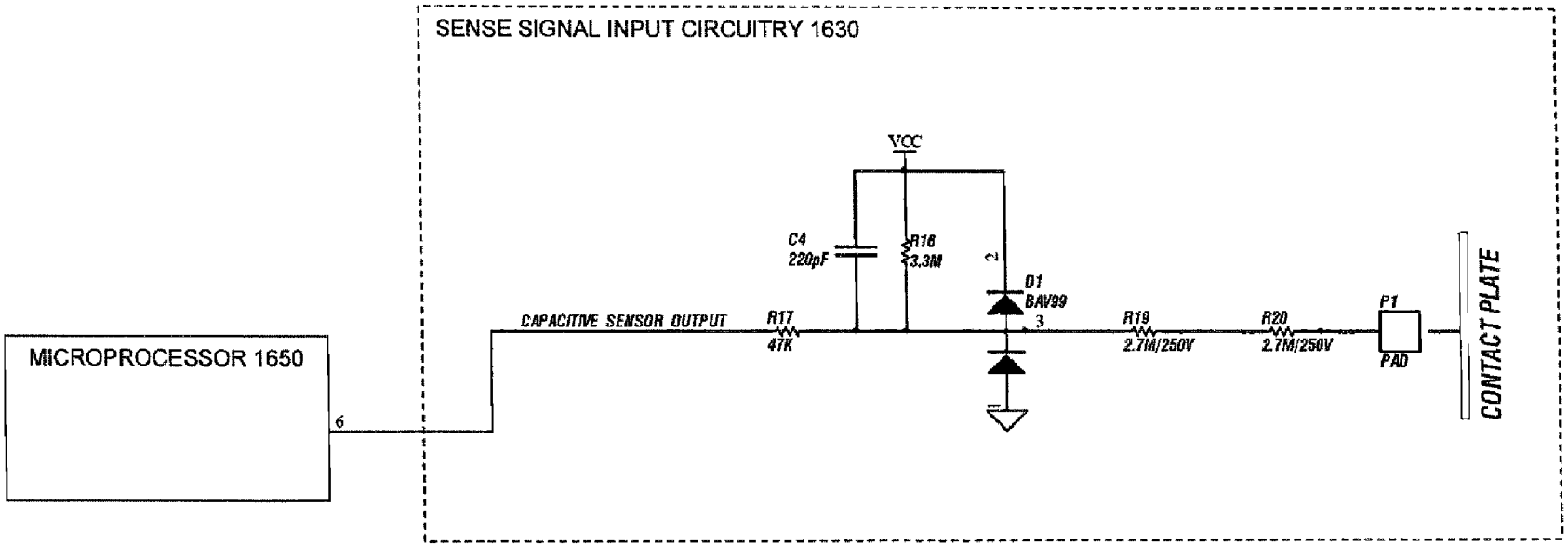

As illustrated in FIGS. 14-27, and in particular FIG. 18, capacitive sensing circuitry monitors an output (CAPACITOR_SENSOR_OUTPUT) to determine whether a large object is nearby. FIG. 28 illustrates simulation data for such capacitive sensing circuitry designed to differentiate between the size of an object. That output signal, as observed by an input at a microprocessor, would appear as illustrated in FIG. 28. Thus, the lowest curve has 40 pF applied to the contact plate and the top curve has 5 pF applied. The traces in between are plotted for increments of 5 pF.

Therefore, as will readily understood, the applied capacitance changes the output signal strength. The relationship between applied capacitance and output signal strength can be read by the microprocessor in many ways. For example, as illustrated in FIGS. 14-19, a microprocessor can perform an analog-to-digital conversion to determine the slope, time below a certain voltage, and minimum voltage of the CAPACITOR_SENSOR_OUTPUT signal. All of these characteristics can be used to determine the strength of signal and thereby the size of the object in contact with the sensor. Alternatively, a comparator may incorporated to perform a threshold determination at a certain voltage. The comparators output will be active longer for a stronger signal as the signal will be below the threshold for a longer period of time. This output can then trigger an analog integrator which is then tested to determine the size of the coupled object. This approach can avoid the expense of a microprocessor. The coupling between the object being sensed and ground also affects the signal strength. A long term solution may include field testing or a manual sensitivity adjustment to account for these environmental differences.

Thus, a capacitive sensing mechanism may be implemented utilizing circuitry in various configurations; for example, the capacitive sense circuitry may be configured to sense the presence of a large body only when the shredder is in the forward ON condition. Nevertheless, it should be appreciated that other implementations of the capacitive sense circuitry may detect a large body and prevent shredder operation in both forward and reverse conditions.

Figure 14:
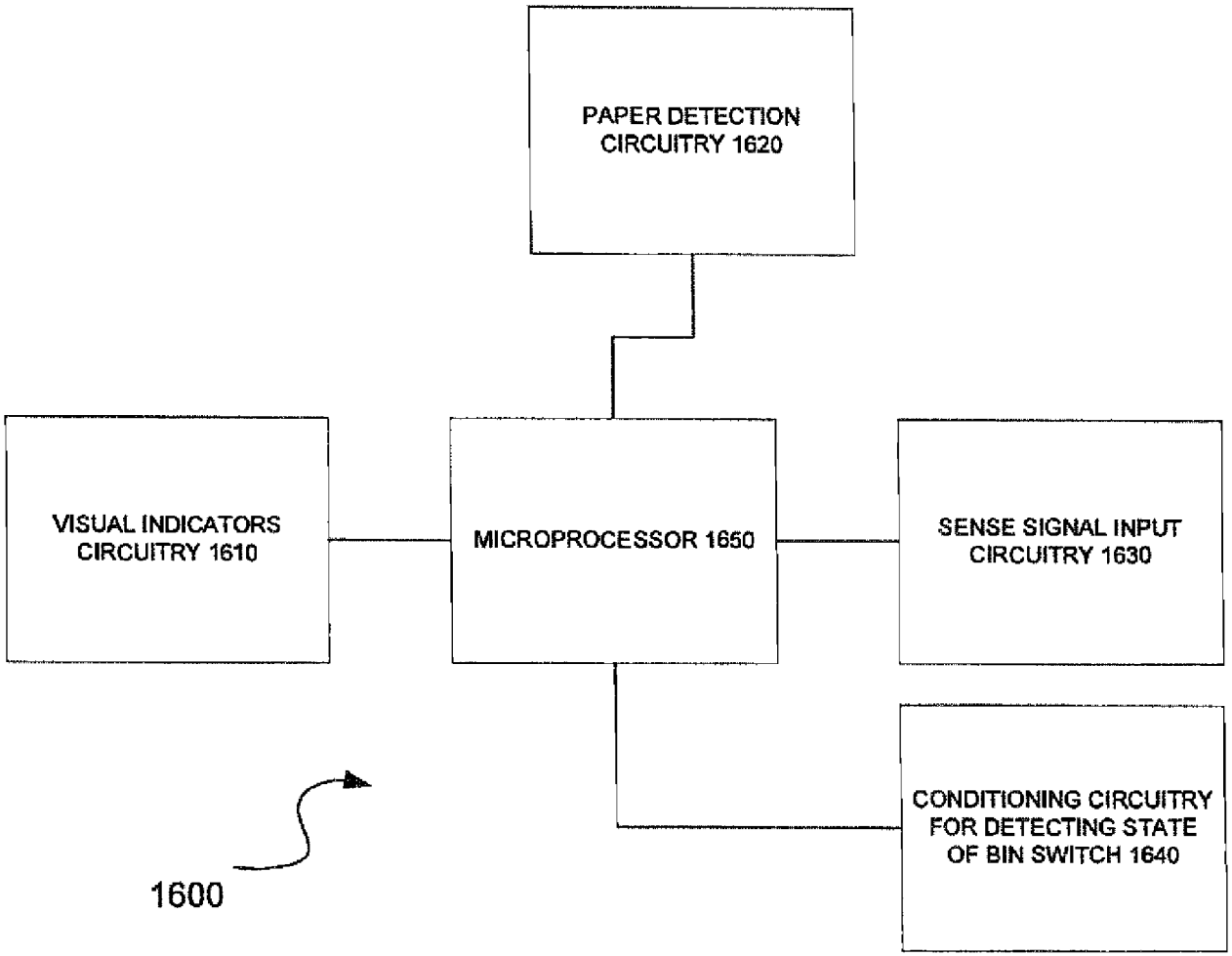
FIGS. 14-27 illustrate capacitive sensing shredder circuitry utilized in accordance with at least one embodiment of the invention and sub-components thereof.
Figure 20:
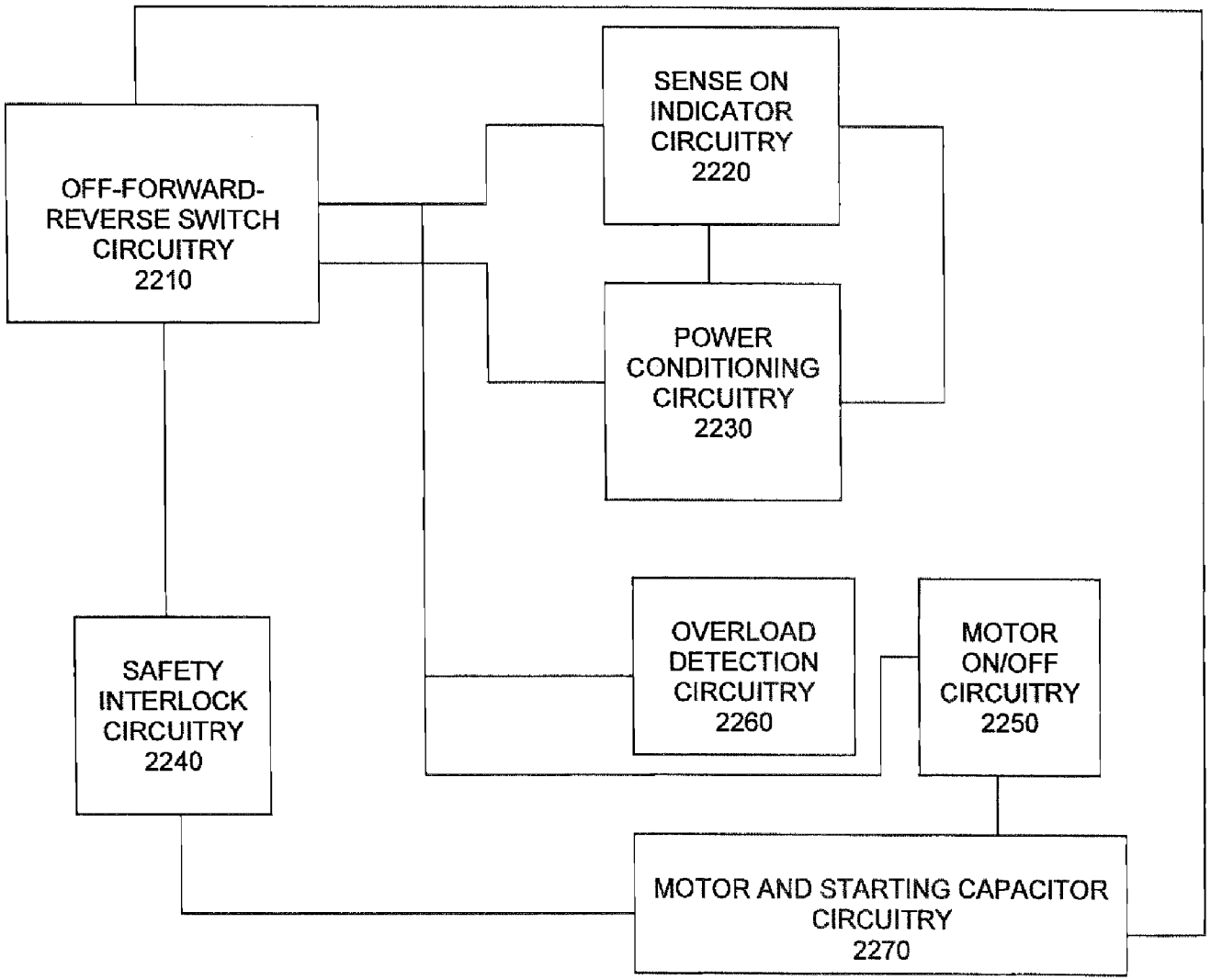

As illustrated in FIG. 14, in accordance with one implementation in accordance with at least one embodiment, a capacitive sensing mechanism 1600 includes visual indicator circuitry 1610, paper detection circuitry 1620, sense signal input circuitry 1630, conditioning circuitry 1640, and a microprocessor 1650. Further, as illustrated in FIG. 20, the capacitive sensing mechanism 1600 also includes OFF-Forward-Rev switch circuitry 2210, sense-on indicator circuitry 2220, power conditioning circuitry 2230, safety interlock circuitry 2240, motor on/off circuitry 2250, overload detection circuitry 2260, motor and starting capacitor circuitry 2270.

Figure 15:
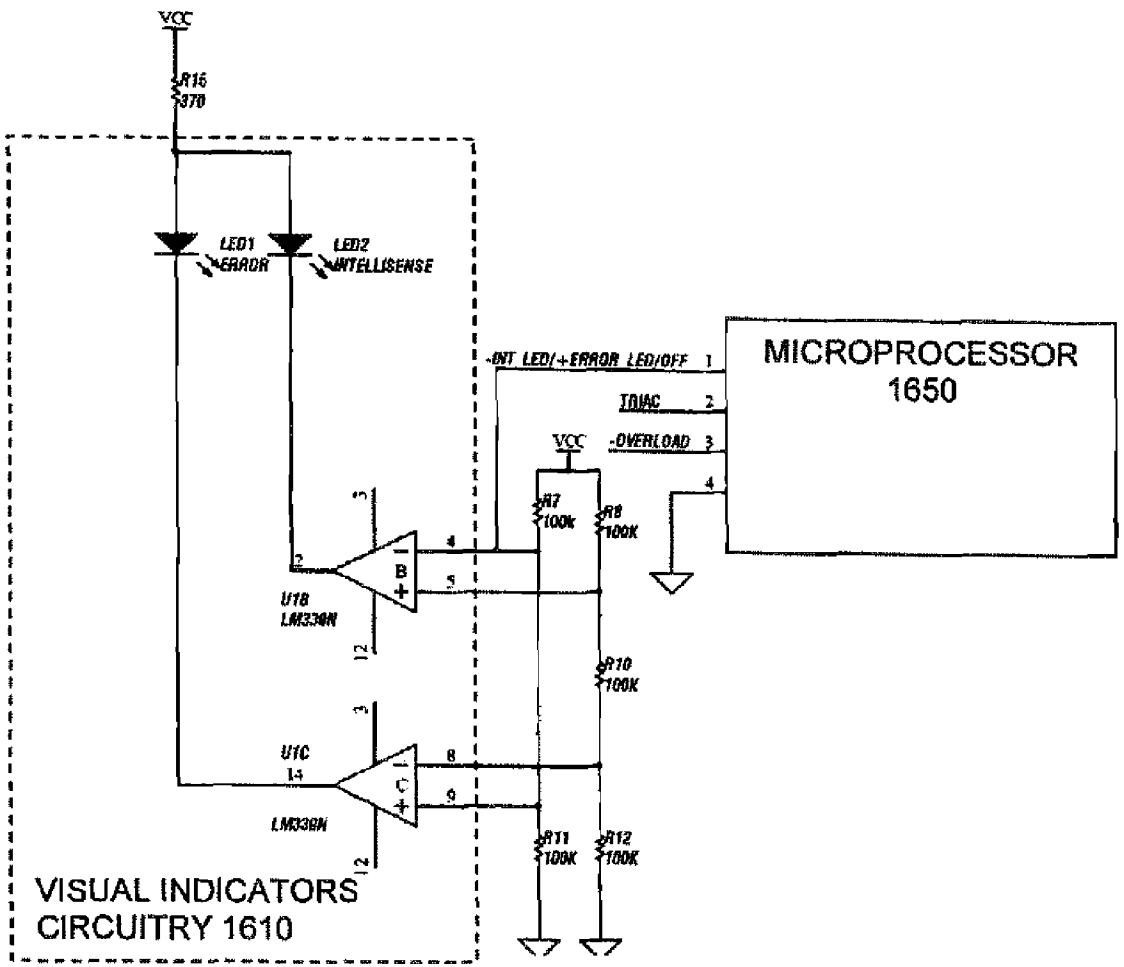

As further illustrated in FIG. 15, the visual indicator circuitry 1610 includes LED's controlled by the microprocessor that indicate detection of a body and error conditions such as motor overload.

As further illustrated in FIG. 16, the paper detection circuitry 1620 includes circuitry for detecting when paper or some other material to be shredded is present. The microprocessor 1650 generates a signal that causes the A06IR emitter to turn on and off as some frequency (10 Khz). The on/off IR signal is picked up by the detector (when paper is not present) and integrated to provide a signal back to the microprocessor indicating the presence or absence of paper in the shredder throat area.

As illustrated in FIG. 17, the microprocessor 1650 for controlling operation. The microprocessor 1650 uses the inputs from the touch plate, motor current and paper detection circuitry 1620 to determine the state of the indicators and control motor turn on/off when the switch is in the forward position.

As further illustrated in FIG. 18, the sense signal input circuitry 1630 that provides the sense input to the microprocessor 1650. The input stays at a high level (following the AC line) when a large body is not present. In this particular implementation, the input is kept high (following the AC line) by the 2.2 MΩ pull-up resistor "Rp" tied to VCC. The input pulses low (relative to Vcc) when a body comes in contact or near the contact plate. The low pulses are the result of the capacitance and/or resistance to earth ground via the contact plate. The capacitance/resistance to earth ground allows a very small current flow through the two series 2.2 MΩ resistors along and resistor Rp. As a result, there is a voltage drop across the Rp.

Figure 19:
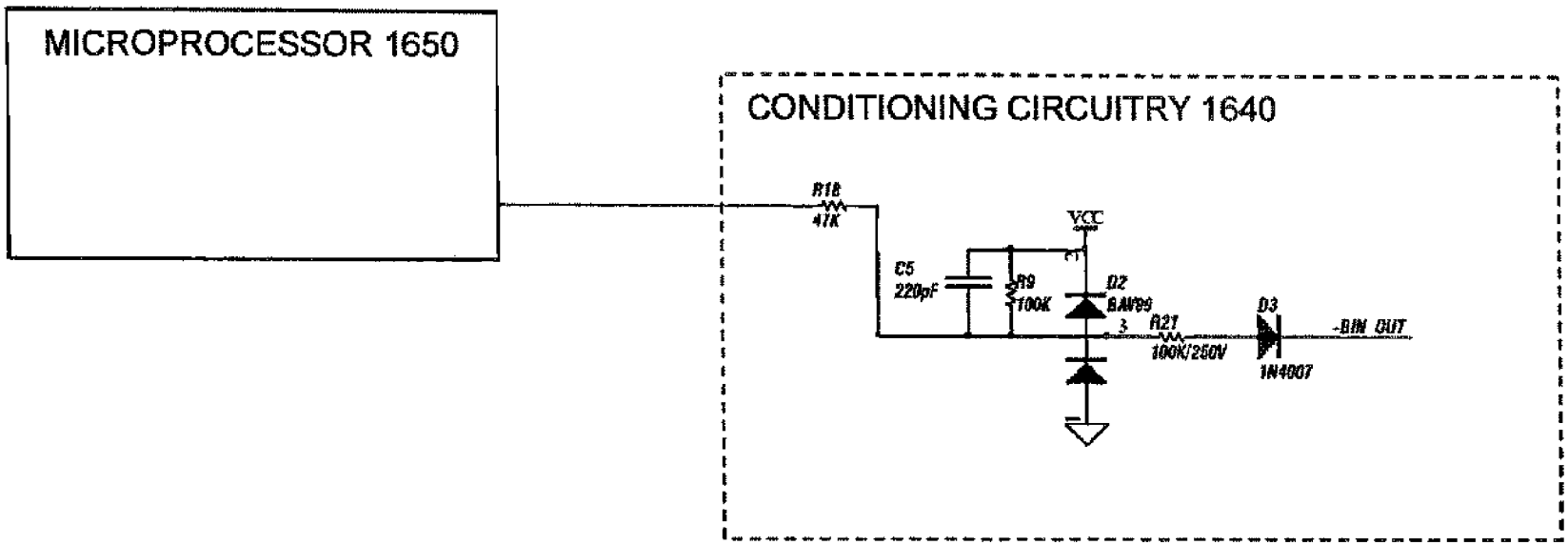

As illustrated in FIG. 19, the conditioning circuitry 1640 includes circuitry connecting to the bin switch, which keeps voltages at levels suitable for the microprocessor A20.

Figure 21:
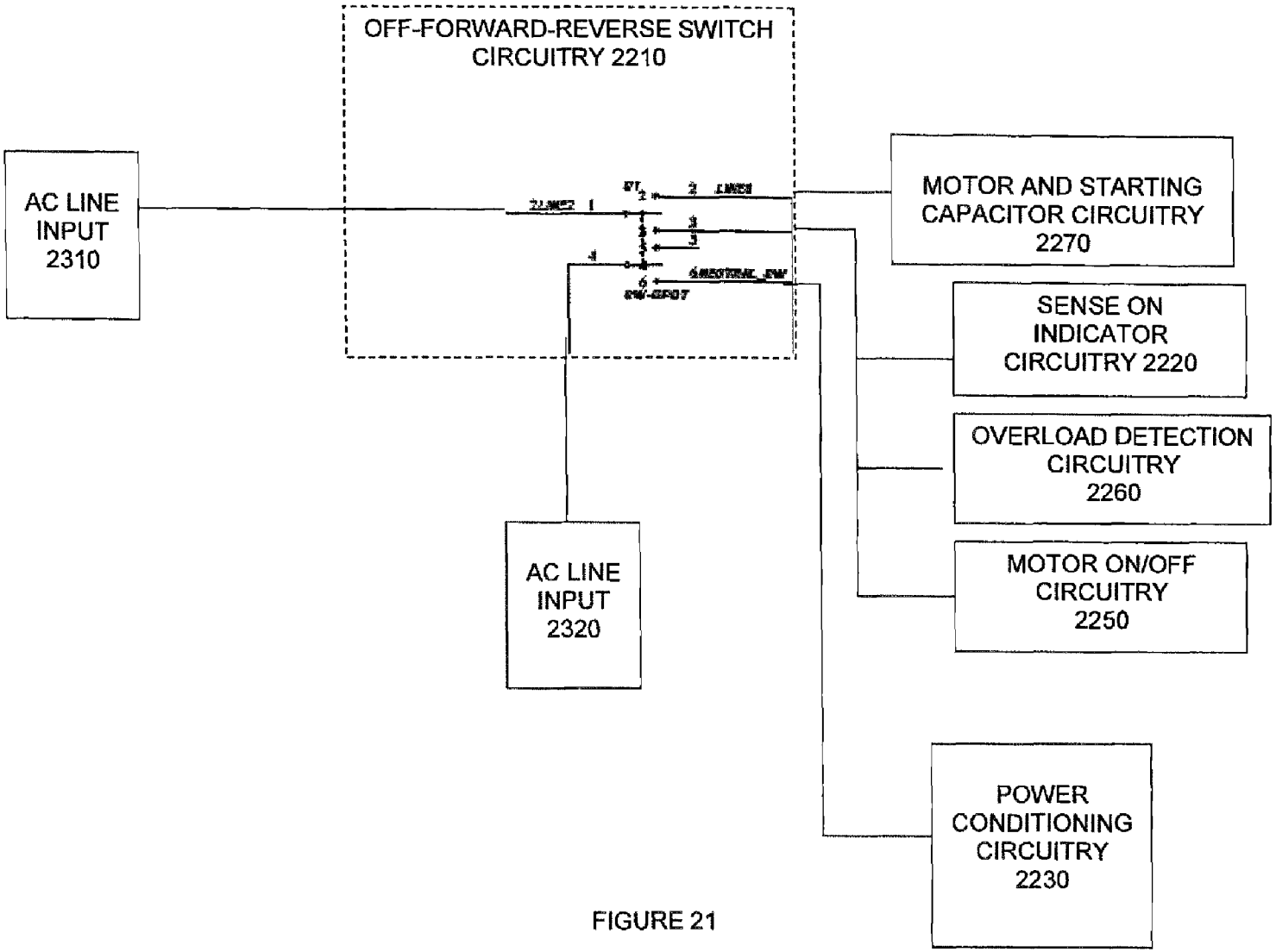

As illustrated in FIGS. 20 and 21, the OFF-Forward-Rev switch circuitry 2210 includes a switch for controlling motor direction and applying power to DC circuits such as microprocessor.

Figure 22:
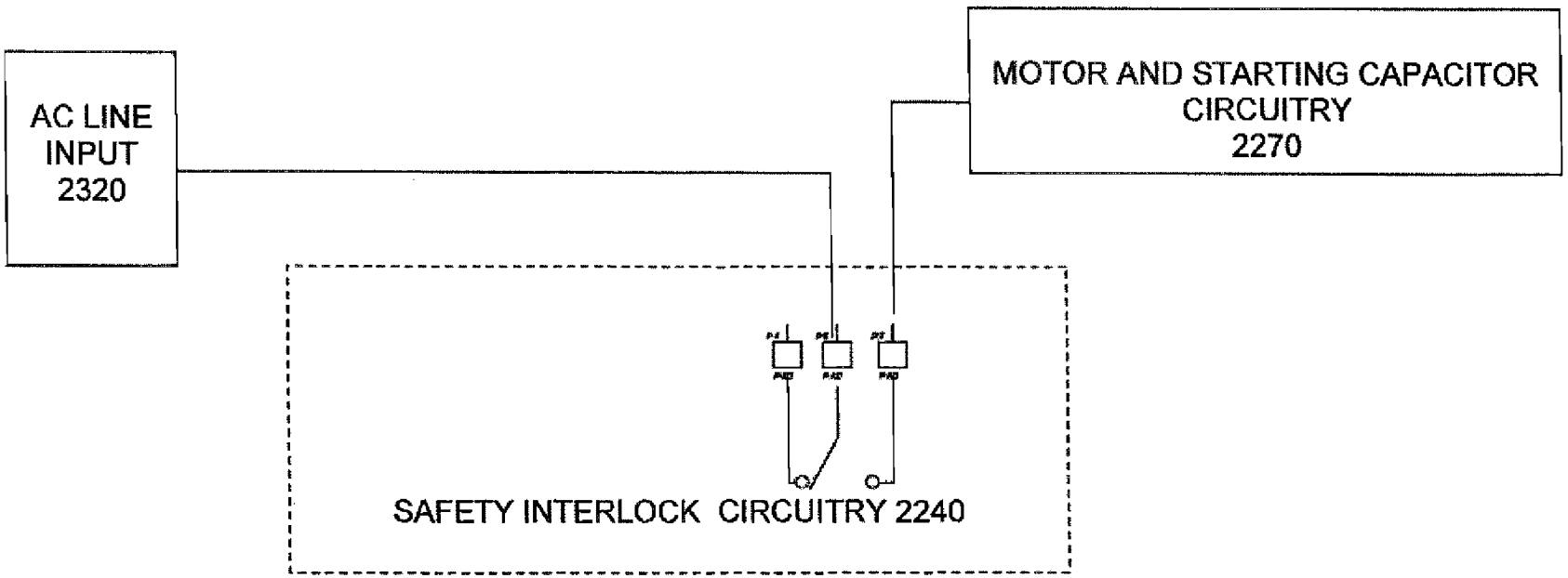

As illustrated in FIG. 22, the safety interlock circuitry 2240 includes a switch that prevents the motor from being active if the bin, for catching the shredded material, is removed.

Figure 23:
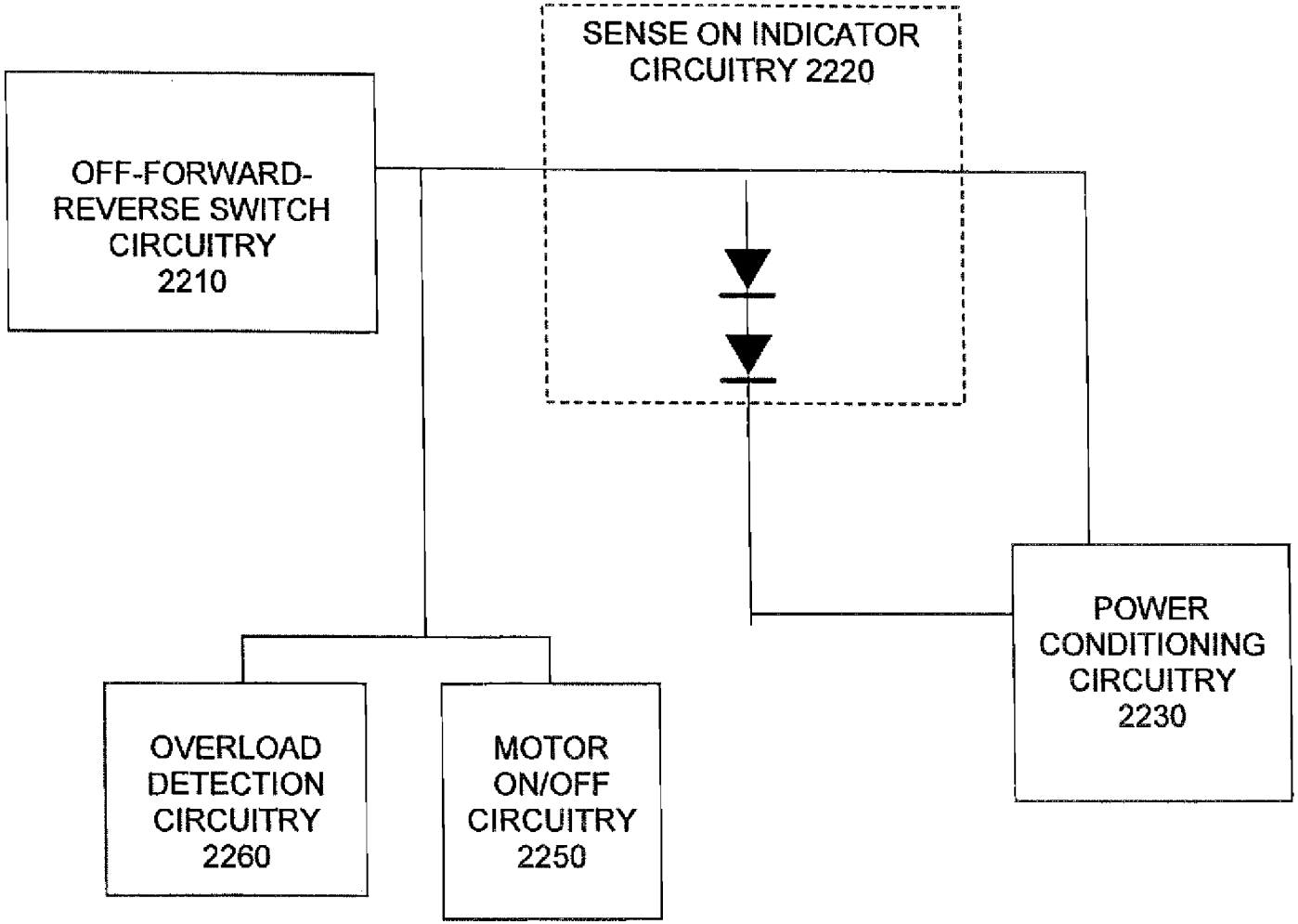

As illustrated in FIG. 23, the sense-on indicator circuitry 2220 provides an indicator of power "on" and "sense active" when the switch is in a forward position.

Figure 24:
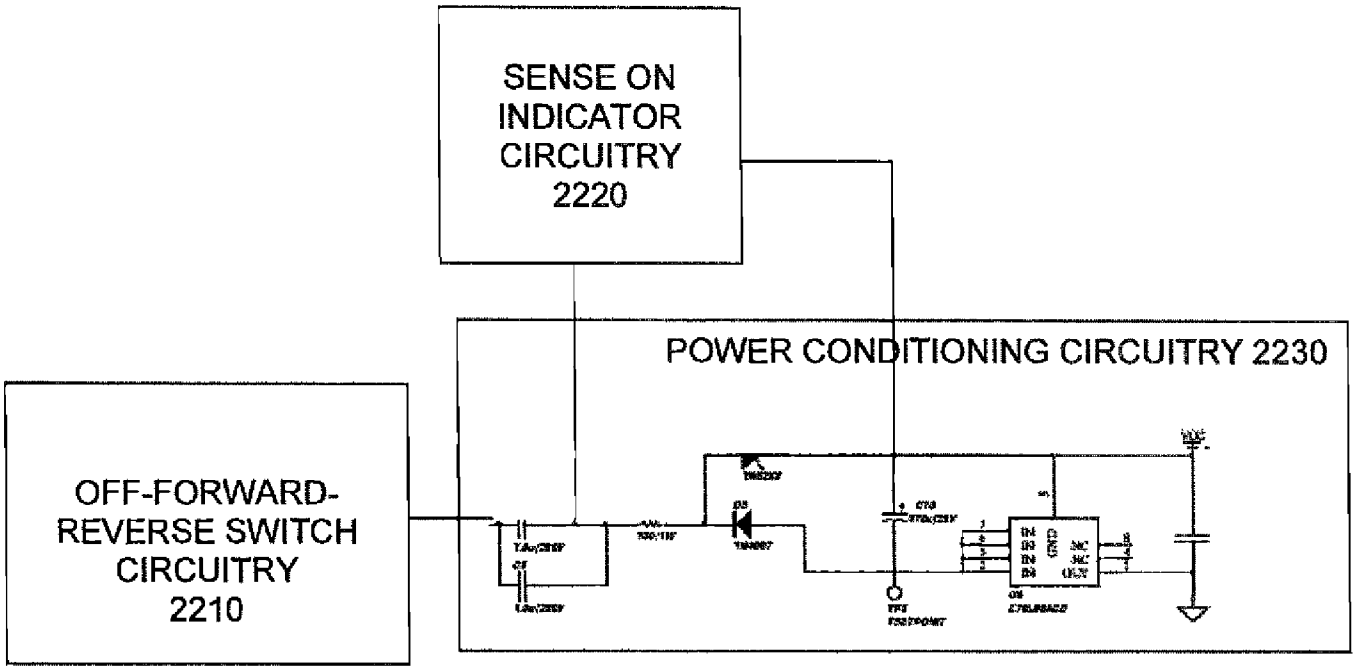

As illustrated in FIG. 24, the power conditioning circuitry 2230 includes circuitry converts the AC line voltage to low voltage required by the microprocessor 1650 (illustrated in FIG. 14). It should be noted that, in this particular implementation, the DC voltage (Vcc) is riding on the high side of the AC line. Thus, the Vcc connection is always at the instantaneous value of the AC line relative to the AC neutral and earth ground.

Figure 25:
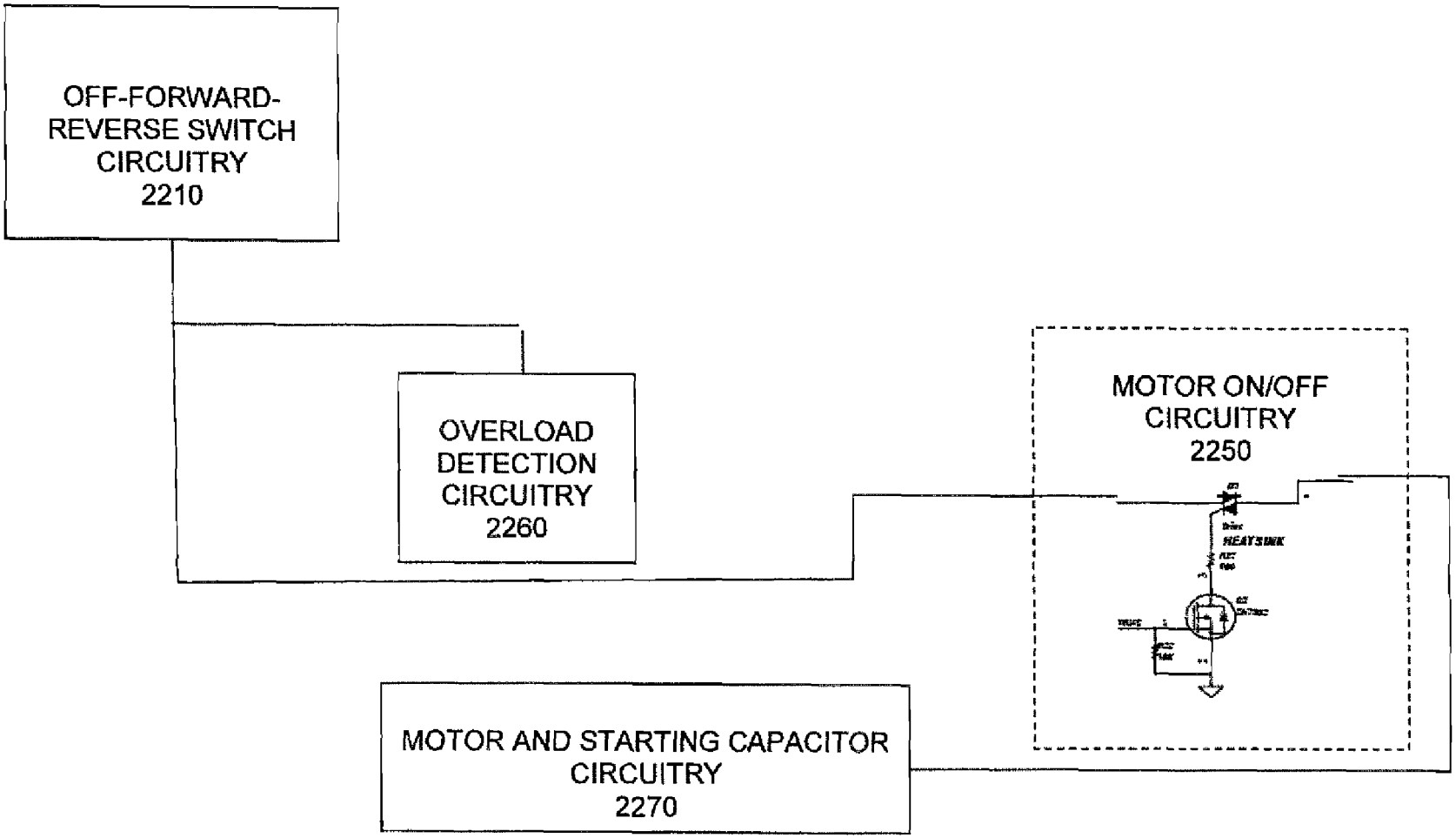

As illustrated in FIG. 25, the motor on/off circuitry 2250 includes an amplifier and switch for allowing the microprocessor to control the motor on and off.

Figure 26:
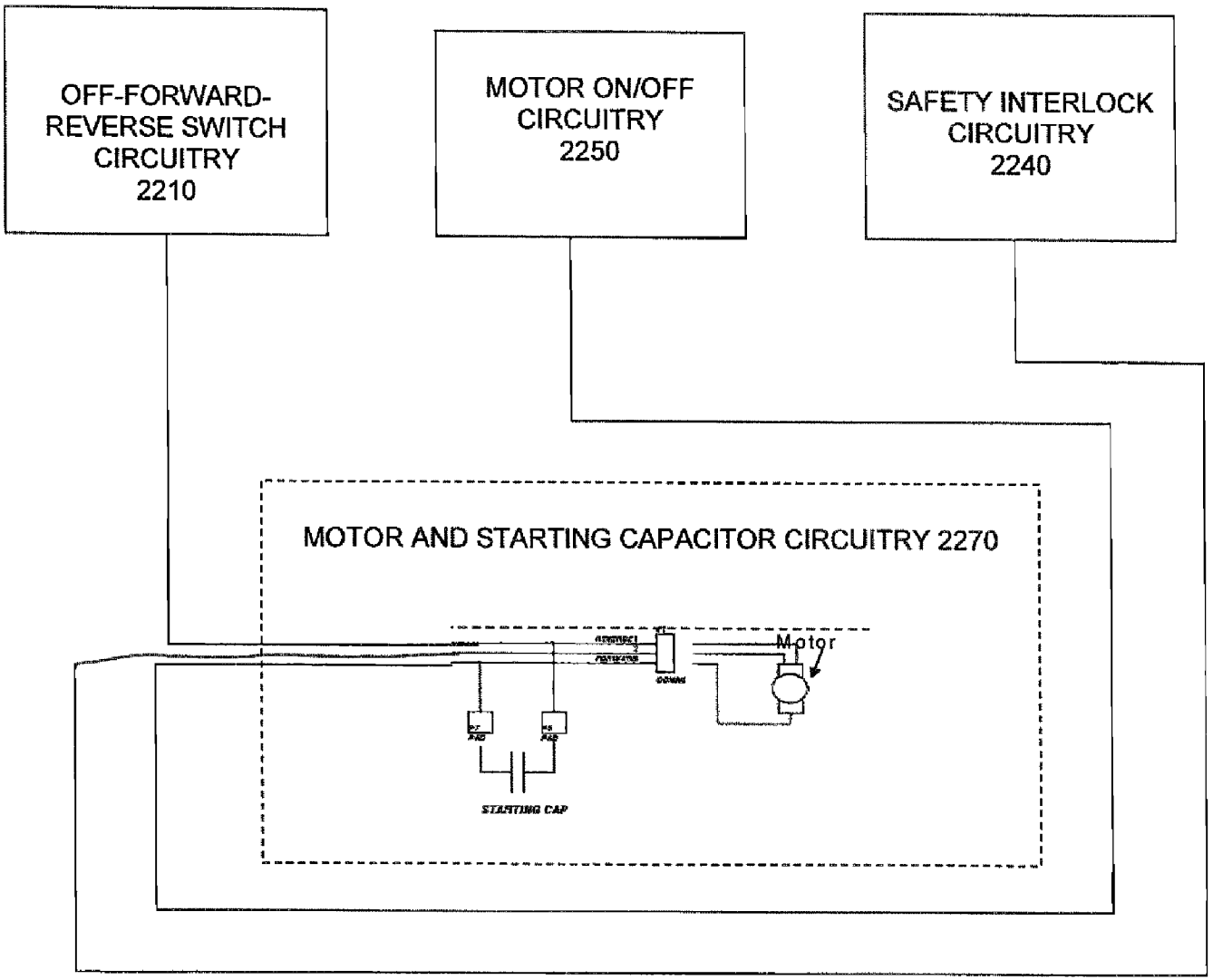

As illustrated in FIG. 26, the motor and starting capacitor circuitry 2270 includes a motor and capacitor for start up. The connection of the start capacitor to the motor leads controls the motor direction.

Figure 27:
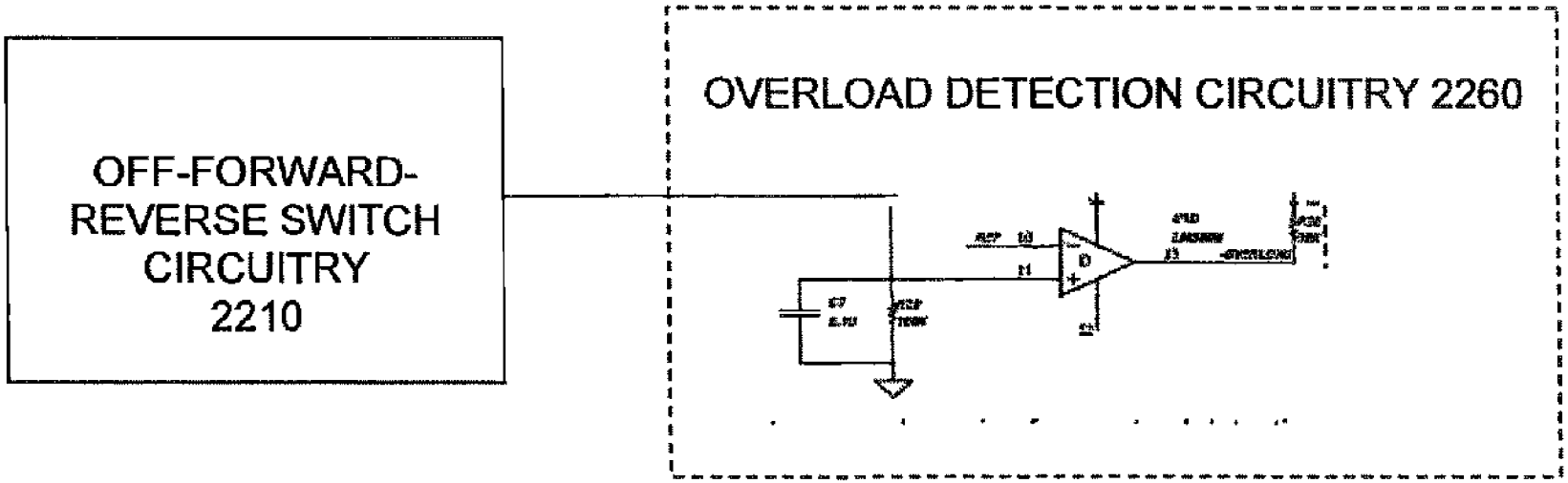
Figure 28:
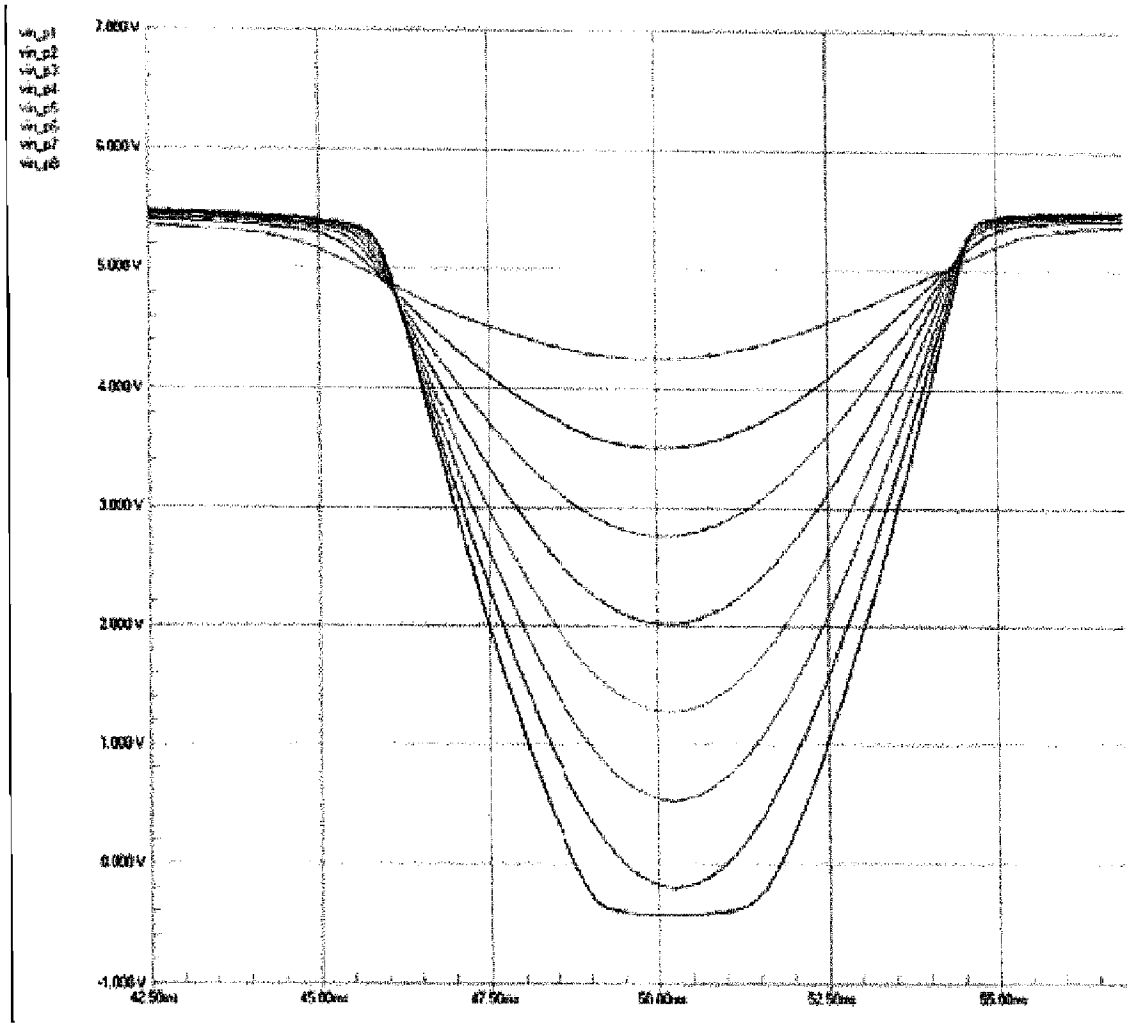
FIG. 28 illustrates a graph of a capacitor sensor output produced in association with at least one embodiment of the invention.
Figure 29:
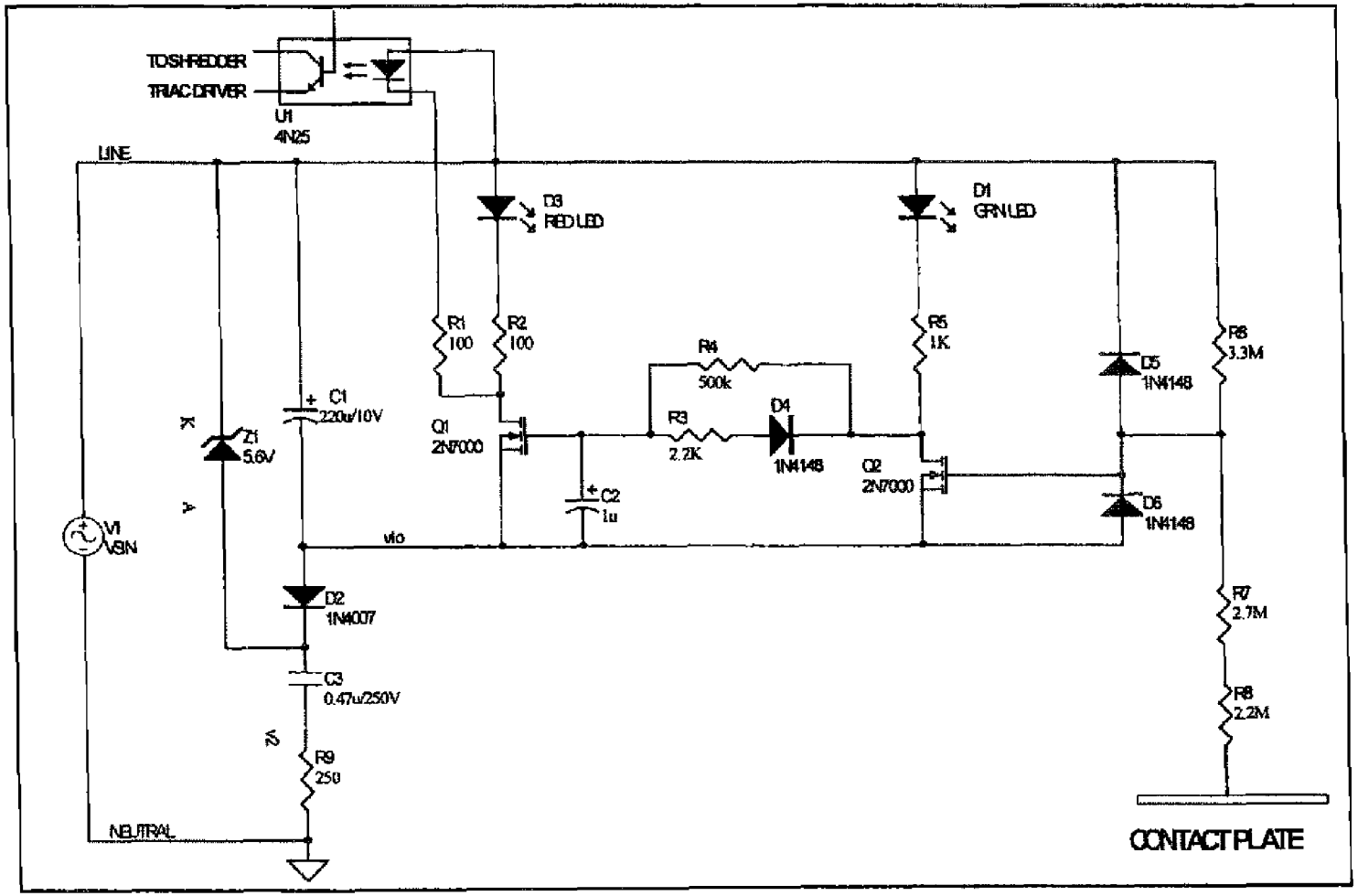
FIG. 29 illustrates one example of a capacitive sensor utilized in accordance with at least one embodiment of the invention.

As illustrated in FIG. 27, the overload detection circuitry 2260 includes a sense resistor "Rs" is in series with the motor such that the motor current passes through it (in the forward direction only in this particular implementation). As the motor load increases, the current increases across Rs. When the current reaches a predetermined level, the overload signal to the microprocessor becomes active, i.e., starts pulsing low as shown in the waveform diagram illustrated in FIG. 28.

Further, in accordance with at least one embodiment of the invention, the capacitive sensor may be coupled with one or more mechanisms for sensing excess paper thickness to prevent jamming of the shredder.

Although various illustrated embodiments herein employ particular sensors, it is to be noted that other approaches may be employed to detect the presence of a person or thing near a shredder, such as, for example, approaches utilizing eddy current, inductive, photoelectric, ultrasonic, Hall effect, or infrared sensor technologies.

Moreover, one of ordinary skill in the art should appreciate that various features described herein may be applied to any power switch including any type of appliance switch and/or switches embedded in building walls.

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A shredder comprising:

a housing;

a shredder mechanism received in the housing and including an electrically powered motor and cutter elements, the shredder mechanism enabling articles to be shredded to be fed into the cutter elements and the motor being operable to drive the cutter elements so that the cutter elements shred the articles fed therein;

the housing having an opening enabling articles to be fed therethrough into the cutter elements of the shredder mechanism for shredding;

an activation sensor operable to detect an inherent electrical characteristic of an operator of the shredder;

a controller, coupled to the activation sensor and the shredder mechanism, the controller being operable to enable operation of the shredder mechanism responsive to the detected inherent electrical characteristic being above a predetermined level, the predetermined level being selected to differentiate between a relatively larger human operator and a relatively smaller human operator and prevent operation by the relatively smaller human operator.

2. The shredder of claim 1, wherein the sensor is a capacitive sensor and the inherent electrical characteristic is capacitance.

3. The shredder of claim 2, wherein the predetermined level of capacitance corresponds to a predetermined capacitance associated with a human operator of at least 75 lbs.

4. The shredder of claim 1, wherein the controller comprises a microcontroller.

5. The shredder of claim 4, wherein the activation sensor includes an electroconductive element and circuitry to sense a state of the electroconductive element, the activation sensor being configured to detect the inherent electrical characteristic of the operator.

6. The shredder of claim 5, wherein the electroconductive element is a thin metal member extending along a portion of the housing adjacent the opening.

7. The shredder of claim 6, wherein the metal member is provided on an interior surface of the housing.

8. The shredder of claim 7, wherein the metal member is provided only on an interior surface of the housing, and not on an exterior surface.

9. The shredder of claim 7, wherein the metal member is also provided on an exterior surface of the housing.

10. The shredder of claim 7, wherein the portion of the housing on which the metal member is provided has an edge that defines part of the opening, and wherein the metal member extends from the interior surface of the housing to the exterior surface over the edge.

11. The shredder of claim 6, wherein the shredder mechanism is embedded within the housing.

12. The shredder of claim 6, wherein the metal member is at least in part adhered to the portion of the housing.

13. The shredder of claim 12, wherein the metal member comprises metal tape.

14. The shredder of claim 6, wherein the metal member is at least in part covered by a non-conductive member.

15. The shredder of claim 14, wherein the non-conductive member is at least in part covered by a conductive member.

16. The shredder of claim 5, wherein the electroconductive element at least in part comprises metal paint applied to a portion of the housing or to a member associated with the housing.

17. The shredder of claim 5, wherein the electroconductive element includes at least two metal members each extending along a portion of the housing.

18. The shredder of claim 1, wherein the controller at least in part comprises a microprocessor.

19. The shredder of claim 1, wherein the controller at least in part comprises discrete circuit components.

20. The shredder of claim 1, wherein the controller at least in part comprises an analog circuit.

21. The shredder of claim 1, wherein the controller enables operation of the shredder when the detected inherent electrical characteristic is above a first predetermined level or below a second predetermined level, but prevents operation when the detected inherent electrical characteristic is between the first and second predetermined levels.

22. A shredder comprising:

a housing;

a shredder mechanism received in the housing and including an electrically powered motor and cutter elements, the shredder mechanism enabling articles to be shredded to be fed into the cutter elements and the motor being operable to drive the cutter elements so that the cutter elements shred the articles fed therein;

the housing having an opening enabling articles to be fed therethrough into the cutter elements of the shredder mechanism for shredding;

a sensor operable to detect an inherent electrical characteristic of an operator of the shredder;

a controller, coupled to the sensor and the shredder mechanism, the controller being operable to enable operation of the shredder mechanism provided the sensor detects an operator having an electrical characteristic greater than a predetermined level, the predetermined level being selected to differentiate between a relatively larger human operator and a relatively smaller human operator and prevent operation by the relatively smaller human operator.

* * * * *